US012458843B2

(12) United States Patent
Barrett et al.

(10) Patent No.: US 12,458,843 B2
(45) Date of Patent: Nov. 4, 2025

(54) EXERCISE MACHINES AND METHODS FOR CONTROLLING EXERCISE MACHINES TO ASSIST IN TARGETING A MUSCLE

(71) Applicant: Life Fitness, LLC, Franklin Park, IL (US)

(72) Inventors: Tracy Barrett, Tulsa, OK (US); Cory H. Lazar, Park Ridge, IL (US); Juliette C. Daly, Arlington Heights, IL (US)

(73) Assignee: Life Fitness, LLC, Franklin Park, IL (US)

( * ) Notice: Subject to any disclaimer, the term of this patent is extended or adjusted under 35 U.S.C. 154(b) by 88 days.

(21) Appl. No.: 18/589,053

(22) Filed: Feb. 27, 2024

(65) Prior Publication Data

US 2025/0269237 A1 Aug. 28, 2025

(51) Int. Cl.

| | |
|---|---|
| ***A63B 24/00*** | (2006.01) |
| ***A63B 21/00*** | (2006.01) |
| ***A63B 22/06*** | (2006.01) |
| ***A63B 71/06*** | (2006.01) |

(52) U.S. Cl.

CPC ..... *A63B 24/0075* (2013.01); *A63B 21/4034* (2015.10); *A63B 22/0664* (2013.01); *A63B 71/0622* (2013.01); *A63B 2024/0068* (2013.01); *A63B 2024/0093* (2013.01); *A63B 2071/065* (2013.01); *A63B 2220/13* (2013.01); *A63B 2225/093* (2013.01)

(58) Field of Classification Search

CPC ..... A63B 24/0075; A63B 21/4034; A63B 22/0664; A63B 71/0622; A63B 2024/0068; A63B 2024/0093; A63B 2071/065; A63B 2220/13; A63B 2225/093

See application file for complete search history.

(56) References Cited

U.S. PATENT DOCUMENTS

| | | | |
|---|---|---|---|
| 4,334,676 | A | 6/1982 | Rolf |
| 4,614,337 | A | 9/1986 | Rolf |
| 4,635,927 | A | 1/1987 | Shu |

(Continued)

OTHER PUBLICATIONS

Extended European Search Report from European Patent Application No. 24221345.2 dated May 26, 2025.

(Continued)

*Primary Examiner* — Sundhara M Ganesan

(74) *Attorney, Agent, or Firm* — Andrus Intellectual Property Law, LLP

(57) ABSTRACT

An exercise machine for assisting a user in targeting a muscle for an exercise motion. A sensor detects a current use condition while the user performs the exercise motion. The current use condition is one of multiple use conditions. A current activation level of the muscle changes within the multiple use conditions. A control system is operatively coupled to the sensor and is configured to determine the current activation level of the muscle based on the current use condition detected by the sensor, receive a desired activation level of the muscle, and determine a recommended use condition within the multiple use condition to cause the muscle to be at the desired activation level for performing the exercise motion, and to notify the user of the recommended use condition and/or automatically cause the exercise machine based on the recommended use condition, respectively, to assist the user in targeting the muscle.

20 Claims, 20 Drawing Sheets

(56) References Cited

U.S. PATENT DOCUMENTS

| | | | |
|---|---|---|---|
| 4,635,928 | A | 1/1987 | Ogden |
| 4,643,418 | A | 2/1987 | Bart |
| 4,659,074 | A | 4/1987 | Taitel |
| 4,664,371 | A | 5/1987 | Heikki |
| 4,708,337 | A | 11/1987 | Shyu |
| 4,749,181 | A | 6/1988 | Pittaway |
| 5,149,084 | A | 9/1992 | Dalebout |
| 5,213,555 | A | 5/1993 | Hood |
| 5,277,681 | A | 1/1994 | Holt |
| 5,466,200 | A | 11/1995 | Ulrich |
| 5,554,033 | A | 9/1996 | Bizzi |
| 5,591,104 | A | 1/1997 | Andrus |
| 5,601,517 | A | 2/1997 | Haber |
| 5,769,755 | A | 6/1998 | Henry |
| 5,888,172 | A | 3/1999 | Andrus |
| 5,890,995 | A | 4/1999 | Bobick |
| 5,947,872 | A | 9/1999 | Ryan |
| 6,042,519 | A | 3/2000 | Shea |
| 6,095,951 | A | 8/2000 | Skowronski |
| 6,099,439 | A | 8/2000 | Ryan |
| 6,152,856 | A | 11/2000 | Studor |
| 6,203,474 | B1 | 3/2001 | Jones |
| 6,217,486 | B1 | 4/2001 | Rosenow |
| 6,227,968 | B1 | 5/2001 | Suzuki |
| 6,336,891 | B1 | 1/2002 | Fedrigon |
| 6,428,449 | B1 | 8/2002 | Apseloff |
| 6,447,424 | B1 | 9/2002 | Ashby |
| 6,572,512 | B2 | 6/2003 | Anderson |
| 6,846,272 | B2 | 1/2005 | Rosenow |
| 6,885,971 | B2 | 4/2005 | Vock |
| 6,941,239 | B2 | 9/2005 | Unuma |
| 7,056,265 | B1 | 6/2006 | Shea |
| 7,245,430 | B2 | 7/2007 | Kobayashi |
| 7,264,554 | B2 | 9/2007 | Bentley |
| 7,292,151 | B2 | 11/2007 | Ferguson |
| 7,308,818 | B2 | 12/2007 | Considine |
| 7,435,203 | B2 | 10/2008 | Anderson |
| 7,602,301 | B1 | 10/2009 | Stirling |
| 7,918,766 | B2 | 4/2011 | Lu |
| 8,078,426 | B2 | 12/2011 | Pipinich |
| 8,118,720 | B2 | 2/2012 | Sebastian |
| 8,272,997 | B2 | 9/2012 | Anderson |
| 8,784,277 | B2 | 7/2014 | Prats |
| 9,028,369 | B2 | 5/2015 | Hjort |
| 9,126,078 | B2 | 9/2015 | Anderson |
| 9,138,614 | B2 | 9/2015 | Lu |
| 9,216,317 | B2 | 12/2015 | Golen, Jr. |
| 9,238,158 | B2 | 1/2016 | Strommen |
| 9,254,404 | B2 | 2/2016 | Prats |
| 9,283,425 | B2 | 3/2016 | Lu |
| 9,616,275 | B1 | 4/2017 | Rogoff |
| 9,764,179 | B2 | 9/2017 | Prats |
| 9,925,412 | B1 | 3/2018 | Lu |
| 10,188,890 | B2 | 1/2019 | Olson |
| 10,220,259 | B2 | 3/2019 | Brammer |
| 10,226,396 | B2 | 3/2019 | Ashby |
| 10,272,317 | B2 | 4/2019 | Watterson |
| 10,279,212 | B2 | 5/2019 | Dalebout |
| 10,391,361 | B2 | 8/2019 | Watterson |
| 10,426,989 | B2 | 10/2019 | Dalebout |
| 10,433,612 | B2 | 10/2019 | Ashby |
| 10,478,665 | B1 | 11/2019 | Daly |
| 10,493,349 | B2 | 12/2019 | Watterson |
| 10,625,137 | B2 | 4/2020 | Dalebout |
| 10,671,705 | B2 | 6/2020 | Capell |
| 10,688,345 | B1 * | 6/2020 | Lynch ..... G16H 20/30 |
| 10,765,908 | B1 * | 9/2020 | Uehara ..... A63B 21/4001 |
| 10,946,238 | B1 | 3/2021 | Rogus |
| 2002/0019258 | A1 | 2/2002 | Kim |
| 2005/0124466 | A1 | 6/2005 | Rodgers, Jr. |
| 2005/0124467 | A1 | 6/2005 | Rodgers, Jr. |
| 2007/0008318 | A1 | 1/2007 | Matsumoto |
| 2007/0135225 | A1 | 6/2007 | Nieminen |
| 2008/0248926 | A1 * | 10/2008 | Cole ..... A63B 24/00 482/5 |
| 2009/0093349 | A1 | 4/2009 | Cooper |
| 2010/0130893 | A1 * | 5/2010 | Sankai ..... A63B 23/0494 600/587 |
| 2011/0301002 | A1 | 12/2011 | Sebastian |
| 2012/0295768 | A1 | 11/2012 | Prats |
| 2013/0040782 | A1 | 2/2013 | Hjort |
| 2013/0316879 | A1 | 11/2013 | Prats |
| 2013/0345025 | A1 | 12/2013 | Van Der Merwe |
| 2016/0023081 | A1 * | 1/2016 | Popa-Simil ..... B62J 45/412 700/91 |
| 2016/0263418 | A1 | 9/2016 | Prats |
| 2017/0216706 | A1 | 8/2017 | Bleich |
| 2017/0368413 | A1 * | 12/2017 | Shavit ..... A63B 24/0075 |
| 2018/0056104 | A1 * | 3/2018 | Cromie ..... A61H 3/00 |
| 2019/0021931 | A1 * | 1/2019 | Shen ..... A61B 5/389 |
| 2021/0275866 | A1 | 9/2021 | Rogus |
| 2021/0283465 | A1 | 9/2021 | Arceta |
| 2023/0013687 | A1 | 1/2023 | Lu |
| 2023/0025399 | A1 | 1/2023 | Rogus |
| 2023/0148907 | A1 | 5/2023 | Aoki |
| 2023/0414992 | A1 | 12/2023 | Spoo |
| 2024/0009516 | A1 | 1/2024 | Taylor, III |

OTHER PUBLICATIONS

"Muscle Wiki" accessed from https://musclewiki.com/ on Feb. 27, 2024.

"Exercise Finder" accessed from https://www.bodybuilding.com/exercises/finder on Feb. 27, 2024.

"Garmin Muscle Heat Map" accessed from https://www.youtube.com/watch?v=lcX1iNtCIKU on Feb. 27, 2024.

"How to use your COROS watch for strength training" accessed from https://support.coros.com/hc/en-us/articles/360043963592-How-to-use-your-COROS-watch-for-strength-training on Feb. 27, 2024.

"Cross Trainer Connect" accessed from https://www.amazon.com/Life-Fitness-E1TC-XX00-0106-Cross-Trainer-Connect/dp/B01MUY9XXQ on Feb. 27, 2024.

* cited by examiner

EXERCISE MACHINES AND METHODS FOR CONTROLLING EXERCISE MACHINES TO ASSIST IN TARGETING A MUSCLE

FIELD

The present disclosure relates to exercise machines and methods for controlling exercise machines.

BACKGROUND

The following are incorporated herein by reference in entirety:

U.S. Patent Pub. No. 2021/0275866 and U.S. Pat. No. 10,946,238 disclose aspects of exercise machines having frames, whereby pivoting a first frame portion relative to a second frame portion changes a shape of an elliptical path during a striding exercise motion.

U.S. Pat. No. 10,478,665 discloses an exercise apparatus having a frame and first and second pedals that are coupled to the frame so that a user standing on the first and second pedals can perform a striding exercise. The first and second pedals each has a tread member that supports the bottom of a user's foot in a manner that encourages movement of the user's foot relative to the tread member during the striding exercise.

U.S. Pat. No. 9,925,412 discloses an exercise device including a linkage assembly that links a driving member to a driven member so that circular rotation of the driving member causes generally equal circular rotation of the driven member. The linkage assembly includes a linking member, a first crank arm that connects the driving member to the linking member so that rotation of the driving member causes motion of the linking member, and a second crank arm that connects the linking member to the driven member so that the motion of the linking member causes rotation of the driven member. At least one additional crank arm connects the linking member at a rotational axis that is laterally offset from a straight line through the first and second crank arm rotational axes.

U.S. Pat. No. 9,283,425 discloses an exercise assembly having a frame and elongated foot pedal members that are each movable along user-defined paths of differing dimensions. Each foot pedal member has a front portion and a rear portion. Footpads are disposed on the rear portion of one of the first and second foot pedal members. Elongated coupler arms have a lower portion and an upper portion that is pivotably connected to the frame. Crank members have a first portion that is pivotably connected to the front portion of one of the first and second foot pedal members and have a second portion that is pivotably connected to the lower portion of one of the first and second coupler arms, so that each crank member is rotatable in a circular path. Elongated rocker arms have a lower portion that is pivotably connected to one of the first and second foot pedal members in between the foot pad and the crank member and have an upper portion that is pivotably connected to the frame.

U.S. Pat. No. 9,138,614 discloses an exercise assembly having elongated first and second rocker arms that pivot with respect to each other in a scissors-like motion about a first pivot axis. A slider has a slider body that slides along a linear axis extending through and perpendicular to the first pivot axis. A linkage pivotably couples the first and second rocker arms to the slider body. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis.

U.S. Pat. Nos. 9,126,078 and 8,272,997 disclose an elliptical step exercise apparatus in that a dynamic link mechanism can be used to vary the stride length of the machine. A control system can also be used to vary stride length as a function of various exercise and operating parameters such as speed and direction as well as varying stride length as a part of a preprogrammed exercise routine such as a hill or interval training program. In addition, the control system can use measurements of stride length to optimize operation of the apparatus.

U.S. Pat. No. 7,931,566 discloses an elliptical cross trainer that has a rotating inertial flywheel driven by user-engaged linkage exercising a user. A user-actuated brake engages and stops rotation of the flywheel upon actuation by the user.

U.S. Pat. No. 7,918,766 discloses an exercise apparatus for providing elliptical foot motion that utilizes a first and second rocking links suspended from an upper portion of the apparatus frame permitting at least limited arcuate motion of the lower portions of the links. Foot pedal assemblies are connected to rotating shafts or members located on the lower portion of the links so that the foot pedals will describe a generally elliptical path in response to user foot motion on the pedals.

U.S. Pat. No. 6,846,272 discloses an exercise apparatus in which a stride length portion of an elliptical motion can be increased automatically as a function of exercise parameters such as speed. In addition, arm handles can be disconnected manually or automatically from pedal levers.

U.S. Pat. Nos. 6,217,486; 6,203,474; 6,099,439; and 5,947,872 disclose aspects of an exercise apparatus having a pedal that moves in an elliptical path, whereby an angular orientation of the pedal, relative to a fixed, horizontal plane, such as the floor, varies in a manner that simulates a natural heel to toe flexure.

U.S. Patent App. Publication No. 2023/0025399 discloses an exercise machine for performing a striding exercise motion. The exercise machine has a frame, first and second pedal members, first and second foot pads on the first and second pedal members, respectively, wherein the first and second foot pads are configured to move in respective elliptical paths during the striding exercise motion, and first and second rocker arms. The first and second pedal members are pivotably coupled to the first and second rocker arms and move with the first and second rocker arms relative to the frame. An adjustment device pivotably couples the first and second rocker arms to the frame. The adjustment device is configured to actively adjust and set a position of the first and second rocker arms relative to the frame, respectively, which thereby changes an incline shape of the elliptical paths, respectively, during the striding exercise motion.

Additional U.S. patents are relevant for disclosing additional types of exercise machines and control thereof. In particular, U.S. Pat. Nos. 9,238,158 and 9,216,317 disclose stair climbing type exercise machines. U.S. Pat. Nos. 6,572,512; 6,095,951; 4,749,181; 4,664,371; 4,659,074; 4,643,418; 4,635,928; 4,635,927; 4,614,337; and 4,334,676; and, as well as U.S. Patent Pub. No. 2021/0283465 and U.S. patent application Ser. No. 17/946,295, disclose treadmill type exercise machines.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

Certain aspects of the present disclosure relate to an exercise machine configured to assist a user in targeting a muscle for performing an exercise motion. The exercise machine includes a sensor configured to detect a current use condition of the exercise machine while the user is performing the exercise motion. The current use condition is one of multiple use conditions in which the exercise machine is operable for the user to perform the exercise motion, where a current activation level of the muscle of the user to perform the exercise motion changes within the multiple use conditions for operating the exercise machine. A control system is operatively coupled to the sensor. The control system is configured to determine the current activation level of the muscle of the user based on the current use condition of the exercise machine detected by the sensor, receive a desired activation level of the muscle of the user, and determine a recommended use condition within the multiple use condition for operating the exercise machine that would cause the muscle to be at the desired activation level for performing the exercise motion. The control system is further configured to notify the user of the recommended use condition and/or automatically cause the exercise machine to operate based on the recommended use condition, respectively, to thereby assist the user in targeting the muscle for performing the exercise motion.

In certain examples, an incline adjustment device controls an incline for performing the exercise motion, where the incline is different within the multiple use conditions for operating the exercise machine, and where the control system is configured to automatically control the incline adjustment device to change the incline and thereby cause the exercise machine to operate in the recommended use condition. In certain examples, the sensor detects a position of the incline adjustment device. In certain examples, the desired activation level ranges from a minimum activation level to a maximum activation level for the muscle for performing the exercise motion, and an input device is configured to receive a muscle selection input as the muscle to be targeted for performing the exercise motion, where the control system is configured such that when the muscle selection input is received the desired activation level for the muscle corresponding thereto is set to the maximum activation level providable by the exercise machine. In certain examples, a display device is controllable by the control system to generate a maximum selection indication when the current activation level for the muscle is set to the maximum activation level, where subsequently detecting the current activation level to be below the maximum activation level causes the display device to stop generating the maximum selection indication.

In certain examples, depending on the muscle to be targeted, the control system is configured to reduce the incline for performing the exercise motion when the desired activation level is greater than the current activation level.

In certain examples, the sensor is configured to detect a direction in which the user performs the exercise motion as at least part of the current use condition, and the control system is configured to notify the user to change the direction of performing the exercise as at least part of the recommended use condition.

In certain examples, the exercise machine comprises pedals that the user moves to perform the exercise motion, and the sensor detects a direction in the user moves the pedals as at least part of the current use condition.

In certain examples, a display device is controllable by the control system to indicate the current activation level of the muscle of the user based on the current use condition detected by the sensor. In certain examples, the control system is configured to control the display device to generate a graphic of the muscle and to change a visual appearance of the graphic of the muscle based on the current activation level of muscle. In certain examples, the muscle is a first muscle and the user has additional muscles other than the first muscle, where the control system is further configured to determine current activation levels corresponding to the additional muscles, respectively, based on the current use condition detected by the sensor, and the control system is further configured to control the display device to indicate the current activation levels of the additional muscles. In certain examples, the control system is configured to control the display device to generate graphics of the muscle being targeted and the additional muscles and to change colors and/or brightnesses of the graphics based on the current activations levels associated therewith, respectively.

In certain examples, the exercise machine comprises multiple regions with which the user may contact to perform the exercise, where the sensor is configured to detect which of the multiple regions is being contacted by the user as at least part of the current use condition, and where the control system is configured to notify the user to change which of the multiple regions to contact as at least part of the recommended use condition.

In certain examples, a display device is operatively coupled to the control system and the control system is configured to display the current activation of the muscle over time.

Another aspect according to the present disclosure generally relates to a method for controlling an exercise machine to assist a user in targeting a muscle for performing an exercise motion. The method includes detecting via a sensor a current use condition of the exercise machine while the user is performing the exercise motion, where the current use condition is one of multiple use conditions in which the exercise machine is operable for the user to perform the exercise motion. The method further includes determining via a control system a current activation level of the muscle of the user based on the current use condition detected by the sensor, where the current activation level of the muscle of the user to perform the exercise motion changes within the multiple use conditions for operating the exercise machine. The method further includes causing a display device to indicate the current activation level of the muscle and receiving a desired activation level of the muscle. The method further includes determining a recommended use condition within the multiple use conditions for operating the exercise machine that would cause the muscle to be at the desired activation level for performing the exercise motion. The method further includes notifying the user of the recommended use condition and/or automatically causing the exercise machine to operate based on the recommended use condition, respectively, to thereby assist the user in targeting the muscle for performing the exercise motion.

In certain examples, the control system is configured to control an incline adjustment device of the exercise machine to change an incline thereof to cause the exercise machine to operate in the recommended use condition.

In certain examples, the method further includes providing an indication when the user is notified of the recommended use condition and the current activation level of the muscle does not correspond to the desired activation level after a predetermined time.

In certain examples, the desired activation level is received as a selection of the muscle for targeting from among multiple muscles of the user, and upon receiving the selection of the muscle the desired activation level is set to a maximum activation level for the muscle providable by the exercise machine.

In certain examples, the sensor is configured to determine a direction in which the user is performing the exercise motion, and the control system is configured to notify the user to change the direction of performing the exercise motion as at least part of the recommended use condition.

Another aspect according to the present disclosure generally relates to an exercise machine configured to assist a user in targeting a muscle for performing an exercise motion. The exercise machine includes pedals moveable by the user to perform the exercise motion and an incline adjustment device operable to change an incline of performing the exercise motion, where a current activation level of the muscle of the user to perform the exercise motion changes based on the incline. One or more sensors are configured to detect a current use condition of the exercise machine, where the current use condition includes the incline and a direction in which the user is moving the pedals while performing the exercise motion. A control system is operatively coupled to the sensor. The control system being configured to determine the current activation level of the muscle of the user based on the current use condition detected by the one or more sensors, and to receive an input for a desired activation level for the muscle that exceeds the current activation level for the muscle. The control system is further configured to determine a recommended use condition among the multiple use conditions for operating the exercise machine that would cause the muscle to be at the desired activation level for performing the exercise motion. The control system is further configured to control the incline adjustment device to change the incline of the exercise machine and notify the user to change the direction in which the user is performing the exercise motion such that the exercise machine is operated in the recommended use condition to cause the current activation level of the muscle to correspond to the desired activation level.

It should be recognized that the different aspects described throughout this disclosure may be combined in different manners, including those than expressly disclosed in the provided examples, while still constituting an invention accord to the present disclosure.

Various other features, objects and advantages of the disclosure will be made apparent from the following description taken together with the drawings.

BRIEF DESCRIPTION OF THE DRAWINGS

The present disclosure is described with reference to the following Figures. The same numbers are used throughout the Figures to reference like features and like components. Unless otherwise specifically noted, articles illustrated in the drawings are not necessarily drawn to scale.

DETAILED DESCRIPTION OF THE DRAWINGS

Figure 1:
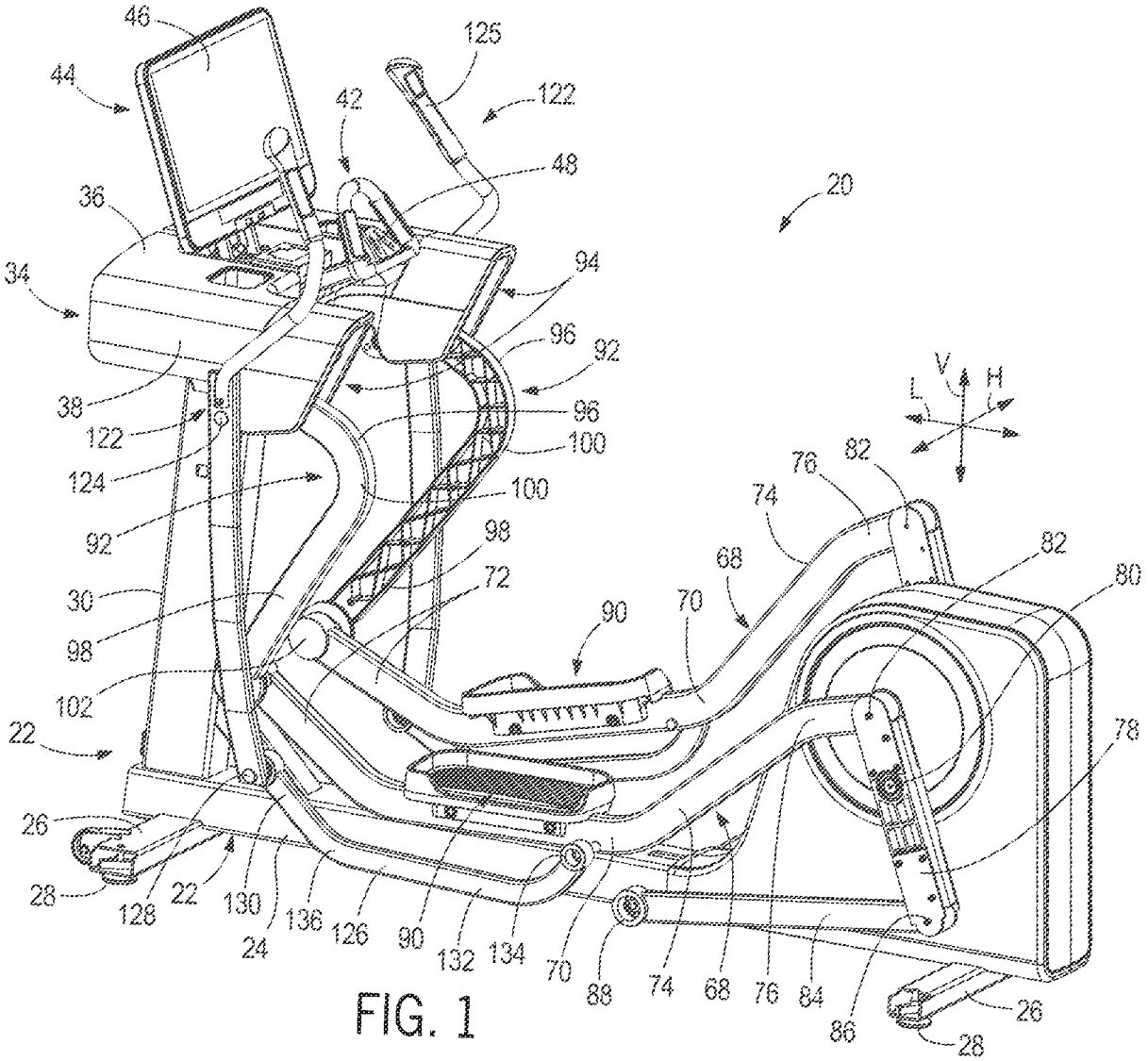
FIG. 1 is a side perspective view of a non-limiting example of an exercise machine according to the present disclosure, having certain features removed such as support column, base member and stabilizer covers.
Figure 2:
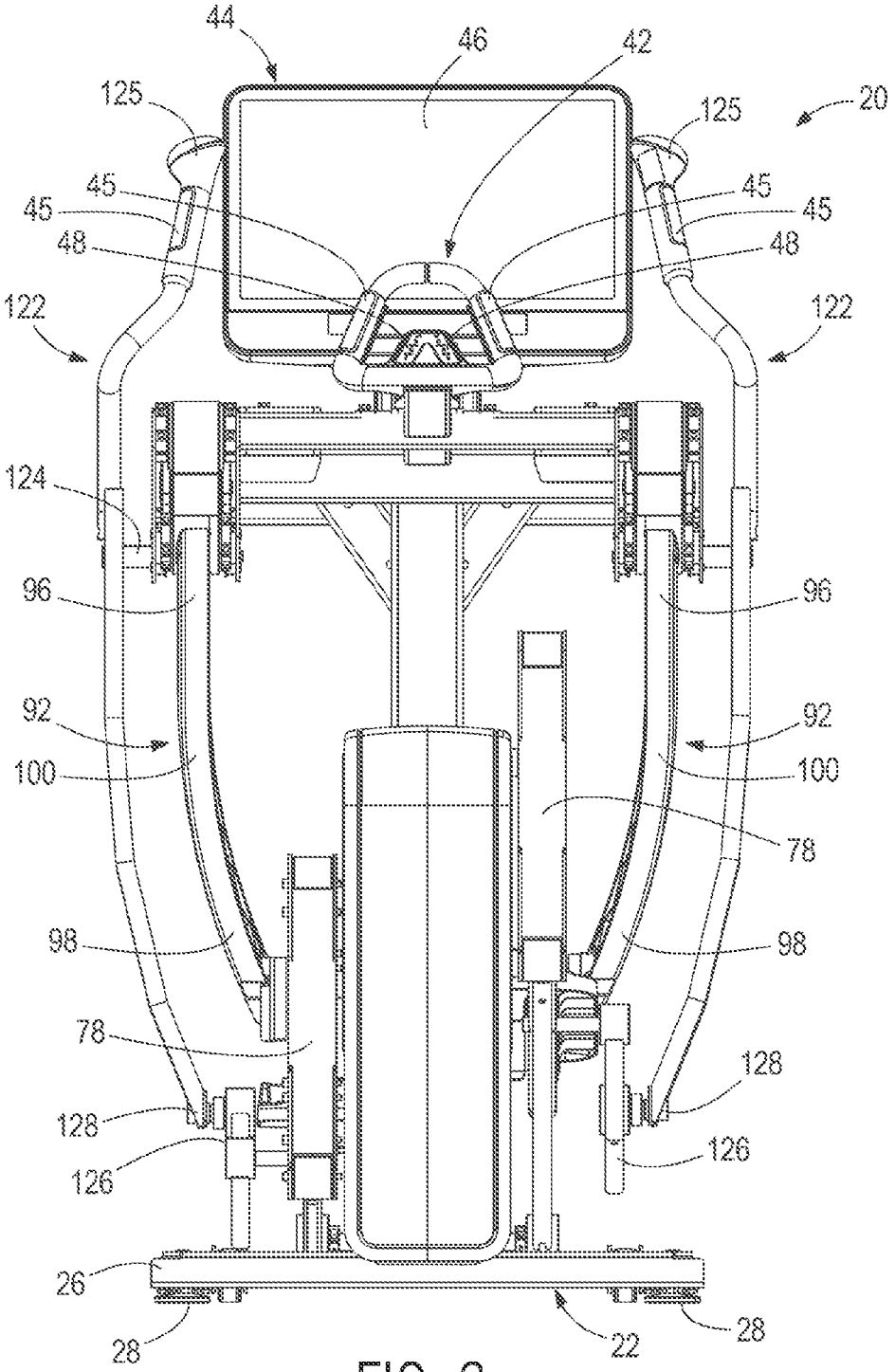
FIG. 2 is a rear view thereof having front a stabilizer covers removed.

Exercise machines such as cross-trainers, arc trainers, treadmills, stair climbers, rowers, and others are useful for cardiovascular and/or strength training. During a workout on such machines, a user can adjust settings of the machine and/or their own exercise motion to alter which muscle groups are targeted for training. In other words, exercise machines have multiple use conditions in which the user may perform the exercise motion. For example, some cross-trainers allow the user to adjust incline and/or resistance settings to focus on certain muscles or muscle groups, also referred to herein as "targeting" or "target muscles". For certain exercise machines presently known in the art, a control system of the cross-trainer can generate muscle heatmaps to show which muscles were used in an exercise based on the settings of the machine and exercise metrics of the user. However, these muscle heatmaps are retroactive and do not enable the user to make changes based on initial and/or real-time data regarding the activation of different muscle groups, or how to set up an exercise program to target those muscles of interest. For example, the control system may indicate to the user that the quadricep muscles were primarily targeted in a completed workout, but the user may have intended to work out their gluteal muscles and were unaware of the settings or motions that would have provided such a result.

The present inventors have thus recognized an unmet need for an interactive muscle map associated with an exercise machine to allow the user to automatically or manually adjust settings of the machine to focus on certain muscle groups without necessarily having prior knowledge of the proper settings that cause the intended results. As discussed further below, the control system of the machine can generate an interactive muscle map to provide one or more muscle groups that the user can select as a muscle to target before or during a workout. The selection of the muscle to be targeted can then be used to automatically adjust machine settings, such as incline, resistance, or a path in which pedals move in a cross-trainer machine. Additionally, or alternatively, the selection of the muscle to target can result in a display device providing instructions for the user to manually make adjustments to change the muscle groups being targeted by performing the exercise motion. These manual adjustments may be adjustments to the exercise machine itself, such as manually changing incline, moving a seat position, or changing a stride length, and/or may be adjustments to how the user is contacting the exercise motion, such as which handlebar to grip, or where on a given handlebar to grip. In contrast to the current use conditions, these recommendations for changes are also referred to as recommended use conditions.

The present inventors have further identified a need for exercise machines and methods for controlling them to not only make recommendations for how to activate target muscles, but that can determine whether this has been done. In other words, it would be advantageous for an exercise machine to not only recommend a particular incline that would activate a target muscle, but also detect that the exercise is being performed at that incline.

Examples of exercise machines and methods for controlling exercise machines for assisting a user in targeting a muscle are disclosed herein. While the description may at times refer to an example of a cross trainer as the exercise machine, it should be recognized that the present disclosure contemplates applications with many other types of exercise machines. Likewise, while the present disclosure generally focuses on activation of muscles within the lower body, it also contemplates exercises performed to target muscles of the upper body (e.g., changing whether the user is gripping handlebars, and/or where on the handlebars the user is gripping).

FIGS. 1-5 illustrate a personal exercise machine 20 for performing a striding exercise motion, and particularly an example of a cross-trainer. The machine 20 extends from front to back in a longitudinal direction L, from top to bottom in a vertical direction V, and from side to opposite side in a horizontal direction H. The machine 20 is substantially symmetrical in the horizontal direction H. Therefore, the components on one side of the machine 20 are the same as, or are mirror images of, the components on the opposite side of the machine 20. As such, the descriptions provided below regarding components on one side of the machine 20 equally apply to the components on the opposite side of the machine 20.

The machine 20 has a frame 22 including a longitudinally extending base member 24. Horizontally extending stabilizer members 26 extend from the front and rear of the base member 24 and prevent the machine 20 from tipping over in the horizontal direction H. Each stabilizer member 26 has feet 28 for supporting the frame 22 above the ground. The frame 22 has a forward support column 30 that extends vertically upwardly from the front of the base member 24. An angular gusset 32 braces and supports the forward support column 30 relative to the base member 24. A bridge 34 is mounted on top of the forward support column 30. The bridge 34 has a horizontally extending body 36 with opposing first and second arms 38 extending rearwardly therefrom. As such, the bridge 34 generally has a U-shape and defines an "activity zone" between the arms 38 for the user's body and/or arms during performance of the striding exercise motion. A generally trapezoidal-shaped stationary handlebar 42 is rigidly mounted on the body 36 between the arms 38 and is at least partially for manually grasping by a user operating the machine 20.

A user console 44 is mounted to and extends generally upwardly from the bridge 34. The console 44 includes a display screen 46 oriented towards the user operating the machine 20. As is conventional, the console 44 can include a processor and memory and be configured for controlling various devices associated with the machine 20, including for control of resistance and/or incline as for example will be further described herein below. The display screen 46 optionally can be a touch screen wherein the user operating the machine 20 can manually touch the screen to input commands to the console 44 for controlling the machine 20. Optionally, input buttons 48 are located on the stationary handlebar 42 and to manually input commands to the console 44. In some examples, the input buttons 48 are located elsewhere such as on the upper ends of handgrips 125, described herein below. Input commands entered via the display screen 46 and/or the input buttons 48 can for example include an increase or decrease in resistance of the machine 20 and/or increase or decrease in incline of the machine 20, and/or the like. Optionally, biomechanical or other types of sensors 45 can be provided on the stationary handlebar 42 and/or on handgrips 125 to sense a presence and/or heart rate of the user when the user contacts or manually grasps the handlebar 42 and/or the handgrips 125. By way of example, these sensors 45 may be resistive or capacitive sensors, pressure sensors, push button sensors, optical sensors, and/or other types of commercially available sensors. In addition or as an alternative to these sensors 45 being positioned on the handlebar 42, sensors 45 may be positioned elsewhere to determine a position of the user. For example, sensors 45 may sense whether a user is seated in the case of an exercise bike. In another handlebar example, multiple sensors 45 are provided in multiple regions of the handlebar so as to be able to detect where the user is gripping the handlebar (e.g., high, low, or intermediate positions, see FIG. 3). Likewise, multiple weight sensor 203 may be provided with foot pedals so as to determine whether the user is standing toward the front, rear, or middle thereof.

The present inventors have recognized that the position of the user and that user is interacting with the exercise machine can impact the exertion requires to perform the exercise, and particularly the level of engagement for different muscle groups in performing the exercise.

It should be recognized that the various devices associated with the machine 20 may be controlled other than via input from the user (e.g., using the touch screen, input buttons 48, and other mechanisms described above). As non-limiting examples, this includes adjustments to the resistance and/or incline in accordance with an exercise program stored and executed by the processor in the console 44 or as changed by an instructor leading the user through an exercise routine. In other words, instructor inputs and exercise programs may also be considered inputs for controlling the exercise machine 20. Additional discussion regarding the control system controlling these various devices is provided below. It should further be recognized that the functions of the console 44 described herein may be provide and/or shared with an external device operatively coupled to communicate with the control system, such as a smartphone. Therefore, for the sake of brevity, an external device that communicates within the control system may be referred to as also being part of the exercise machine 20.

At the rear of the machine 20, the frame 22 further includes a rear support column 50 that extends angularly upwardly and rearwardly from the rear of the base member 24. A resistance mechanism 52 is mounted to the rear support column 50, including for example via a rear frame plate (not illustrated in FIG. 4) mounted to the rear support column 50 and/or the base member 24. The type and configuration of the resistance mechanism 52 can vary from what is illustrated and described. In the illustrated example, the resistance mechanism 52 is a hybrid generator-brake configured to provide a resistance to a striding motion performed on the machine 20, as will be further described herein below, and also configured to generate power based upon the striding motion, for example to power the console 44. In some examples, a suitable resistance mechanism is the "FB Six Series" sold by Chi Hua. The resistance mechanism 52 is connected to a pulley wheel 56 by a belt 58 and is configured so that rotation of the pulley wheel 56 rotates the resistance mechanism 52. The pulley wheel 56 is connected to the rear support column 50 by a center shaft 60 (see FIG. 8). The pulley wheel 56 and center shaft 60 are fixed relative to each other such that these components rotate together.

At the rear of the machine 20, radially opposed crank arms 62 have radially inner ends keyed to (fixed to) the center shaft 60 so that the crank arms 62 remain radially opposed to each other (i.e., 180 degrees apart) and so that rotation of the crank arms 62 and center shaft 60 causes rotation of the pulley wheel 56 about a pulley wheel pivot axis 64 defined by the center shaft 60. In the illustrated examples of FIGS. 1-5, the resistance mechanism 52 resists rotation of the pulley wheel 56 via an electro magnet 66. In some examples, the resistance mechanism 52 includes another means for resisting movement of the pulley wheel 56, such as via a flywheel, mechanical brake, pneumatic actuators, etc.

The machine 20 further has first and second pedal members 68 centrally located on opposite sides of the frame 22. The pedal members 68 are elongated in the longitudinal direction L, each having a central portion 70, a front portion 72 that extends generally forwardly and upwardly from the central portion 70, and a rear portion 74 that extends generally rearwardly and upwardly from the central portion 70 to a tail portion 76 that extends rearwardly from the rear portion 74 and substantially parallel to the central portion 70. In some examples, the tail portion 76 is not substantially parallel to the central portion 70.

At the rear of the machine 20, first and second elongated stride links 78 are freely rotatably (pivotably) coupled to the radially outer ends of the opposed crank arms 62, by for example bearings, at a stride link-crank arm pivot axis 80. Each stride link 78 has a first end that is pivotably coupled to a respective tail portion 76 of a pedal member 68 at a stride link-pedal member pivot axis 82. Each stride link 78 has an opposite, second end that is pivotably coupled to a distal or rear end of an elongated idler link 84 at a stride link-idler link pivot axis 86. The opposite, proximal or front end of the idler link 84 is pivotably coupled to the base member 24 at an idler link-base member pivot axis 88. As illustrated in at least FIGS. 1, 3 and 4, the stride link-crank arm pivot axis 80 is located along the stride link 78 between the stride link-pedal member pivot axis 82 and stride link-idler link pivot axis 86. In some examples, the stride link-crank arm pivot axis 80 is closer to the stride link-pedal member pivot axis 82 than the stride link-idler link pivot axis 86. In other examples, the pivot axis 80 is at the center of the stride link 78 or closer to the pivot axis 86.

First and second foot pads 90 are supported on the central portions 70 of the first and second pedal members 68. The exercise machine 20 includes the first and second foot pads 90 to support the user's feet during performance of the elliptical striding motion. The first and second foot pads 90 travel along an elliptical path that is incline adjustable, as will be further described herein below.

The machine 20 further has first and second rocker arms 92 that are pivotably coupled to the frame 22 by an incline adjustment device 94, which will be further described herein below. The type and configuration of the incline adjustment device 94 can vary and additional examples are illustrated in the examples illustrated (with further detail also being provided in U.S. patent application Ser. No. 17/867,062, which has been incorporated herein in its entirety). The rocker arms 92 have an upper end portion 96, a lower end portion 98, and an elbow portion 100 located between the upper end portion 96 and the lower end portion 98 so that the upper end portion 96 and lower end portion 98 extend at an angle relative to each other. The lower end portions 98 are pivotably coupled to the front portion 72 of the pedal members 68 at a rocker arm-pedal member pivot axis 102 so that the pedal members 68 are pivotably movable relative to the rocker arms 92 and also so that pivoting of the rocker arms 92 relative to the frame 22 causes commensurate pivoting and/or translating of the pedal members 68 relative to the frame 22, i.e., so that these components pivot and/or translate together relative to the frame 22.

Referring to FIGS. 3, 4, 6 and 7, the incline adjustment device 94 is located in the bridge 34 and extends into the noted arms 38 on both sides of the activity zone. The incline adjustment device 94 is specially configured to facilitate selective adjustment and setting of a position of the rocker arms 92 relative to the frame 22, respectively, specifically the position of pivot axis 108, which thereby changes an incline shape of elliptical paths of travel of the foot pads 90, respectively, during the striding exercise motion, as will be further described herein below. The incline adjustment device 94 can be controlled by the noted controller based upon a stored exercise program or based upon an input by the user to the console 44. For example this can be controlled via touch screen, input buttons 48 on the stationary handlebar 42 and/or input buttons on the upper ends of hand grips 125. As will be evident from the illustrated examples and the following description, the type and configuration of the incline adjustment device 94 can vary.

In the first example illustrated in FIGS. 1-10, the incline adjustment device 94 includes an incline link 104 for each of the rocker arms 92, which pivotably couple the upper portion 96 of the rocker arms 92 to the frame 22. More specifically, each incline link 104 has an upper portion that is pivotably coupled to the frame 22 at an incline link-frame pivot axis 106. Each incline link 104 further has a lower portion that is pivotably coupled to the upper end portion 96 of the rocker arm 92 at an incline link-rocker arm pivot axis 108 that is located generally below the incline link-frame pivot axis 106. In some examples, bearings support the noted couplings so that the corresponding incline link 104 is pivotable relative to the noted axes 106, 108.

The incline adjustment device 94 is configured to pivot each incline link 104 relative to the frame 22 (i.e., about the incline link-frame pivot axis 106) to thereby adjust and set the position of the rocker arms 92 relative to the frame 22, in particular to adjust and set the position of the incline link-rocker arm pivot axis 108 relative to the frame 22 (i.e., about the incline link-frame pivot axis 106). In the illustrated example, the incline adjustment device 94 includes first and second linear actuators 110. Note that the type of linear actuator 110 can vary from what is illustrated and described. In the illustrated example, the linear actuator 110 includes an electro-mechanical linear actuator, which has an electric gearmotor 120, a leadscrew assembly 121 and, a leadnut and tube assembly 125 (see FIGS. 6 and 7). The linear actuator 110 has a forward end pivotably coupled to the bridge 34 by a trunnion assembly 113, particularly at an actuator-bridge pivot axis 114. The linear actuator 110 has an opposite, rear end pivotably coupled to the incline link 104 at an actuator-incline link pivot axis 118 (see FIG. 6). An example bearing, which is best seen in exploded view in FIG. 7, supports the coupling at the actuator-incline link pivot axis 118. The actuator-incline link pivot axis 118 is offset relative to the incline link-frame pivot axis 106 and the incline link-rocker arm pivot axis 108. In certain cases, the actuator-incline link pivot axis 118 is offset forwardly relative to the incline link-frame pivot axis 106 and the incline link-rocker arm pivot axis 108. In the illustrated non-limiting example, the incline link 104 is a member or body having or defining a triangular shape, wherein the incline link-frame pivot axis 106, the incline link-rocker arm pivot axis 108, and the actuator-incline link pivot axis 118 are located at the respective three apexes of the triangular shape.

The gearmotor 120, leadscrew assembly 121, and leadnut and tube assembly 125 are configured to lengthen or shorten the linear actuator 110 upon an input command from the noted controller, which can be based upon a user input to the console 44 or based upon a program in the noted controller, as described herein above. Operation of the gearmotor 120 in a first direction rotates the lead screw 123 of the leadscrew assembly 121 in the first direction that causes the leadnut and tube assembly 125 to travel outwardly along the lead screw 123 and outwardly relative to the housing 119 of linear actuator 110, thus lengthening the linear actuator 110. Operation of the gearmotor 120 in an opposite, second direction oppositely rotates the lead screw 123 in the second direction that cause the leadnut and tube assembly 125 to retract inwardly relative to the housing 119, thus shortening the linear actuator 110. Due to the relative locations of the incline link-frame pivot axis 106, incline link-rocker arm pivot axis 108, actuator-bridge pivot axis 114, and actuator-incline link pivot axis 118, extension of the linear actuator 110 pivots the incline link 104 rearwardly along an arc relative to the bridge 34. Such actuation of the linear actuator 110 also moves the incline link-rocker arm pivot axis 108 rearwardly (e.g., relative to the frame 22) and along an arc relative to the incline link-frame pivot axis 106. As illustrated and described herein below, this increases or raises the incline of the elliptical path of the foot pads 90 (e.g., relative to the frame 22). Conversely, shortening the linear actuator 110 pivots the incline link 104 forwardly along the arc relative to the bridge 34, along an arc relative to the incline link-frame pivot axis 106. This moves the incline link-rocker arm pivot axis 108 forwardly along the arc relative to the frame 22. As illustrated and described herein below, this reduces or lowers the incline of the elliptical path of the foot pads 90 (e.g., relative to the frame 22). In examples disclosed herein, the incline adjustment device 94 can adjust the incline of the elliptical path of the foot pads 90 during the striding motion.

It is important to note that the incline adjustment device 94 does not need to include two actuators, as shown in the first example. In other examples, a single adjustment device connected to more than one incline link 104. In addition to linear actuators, devices for changing the position an incline link 104 include an electric motor driving worm gears, the use of pulleys, and/or any other conventional mechanism for causing the above-noted adjustment of the relative position of the axes.

Referring to FIGS. 1-5, the machine 20 has movable handle members 122 that are pivotably coupled to opposite sides of the bridge 34 at a handle member-bridge pivot axis 124. Each handle member 122 has an upper end with a hand grip 125 for manually grasping by the user performing the striding exercise motion. Each handle member 122 has a lower end that is pivotably coupled to a coupler link 126 at a handle member-coupler link pivot axis 128. Thus, the handle member 122 and respective coupler link 126 pivot together about the handle member-bridge pivot axis 124 and the coupler link 126 is pivotable relative to the handle member 122 about the handle member-coupler link pivot axis 128. Each coupler link 126 has a forward end portion 130 coupled to the handle member 122 at the handle member-coupler link pivot axis 128 and a rearward end portion 132 pivotably coupled to the central portion 70 of the pedal member 68 at a coupler link-pedal member pivot axis 134. Thus, the coupler link 126 is pivotable relative to the pedal member 68 about the coupler link-pedal member pivot axis 134. An elbow portion 136 is located between the forward and rearward end portions 130, 132 so that the forward end portion 130 extends angularly upwardly relative to the rearward end portion 132. As such, the user standing on the foot pads 90 and manually grasping the hand grips 125 can alternately push and pull on the hand grips 125 to thereby apply pushing and pulling forces on the pedal members 68 via the coupler links 126, which assists the striding exercise motion, as will be further described herein below.

Figure 8:
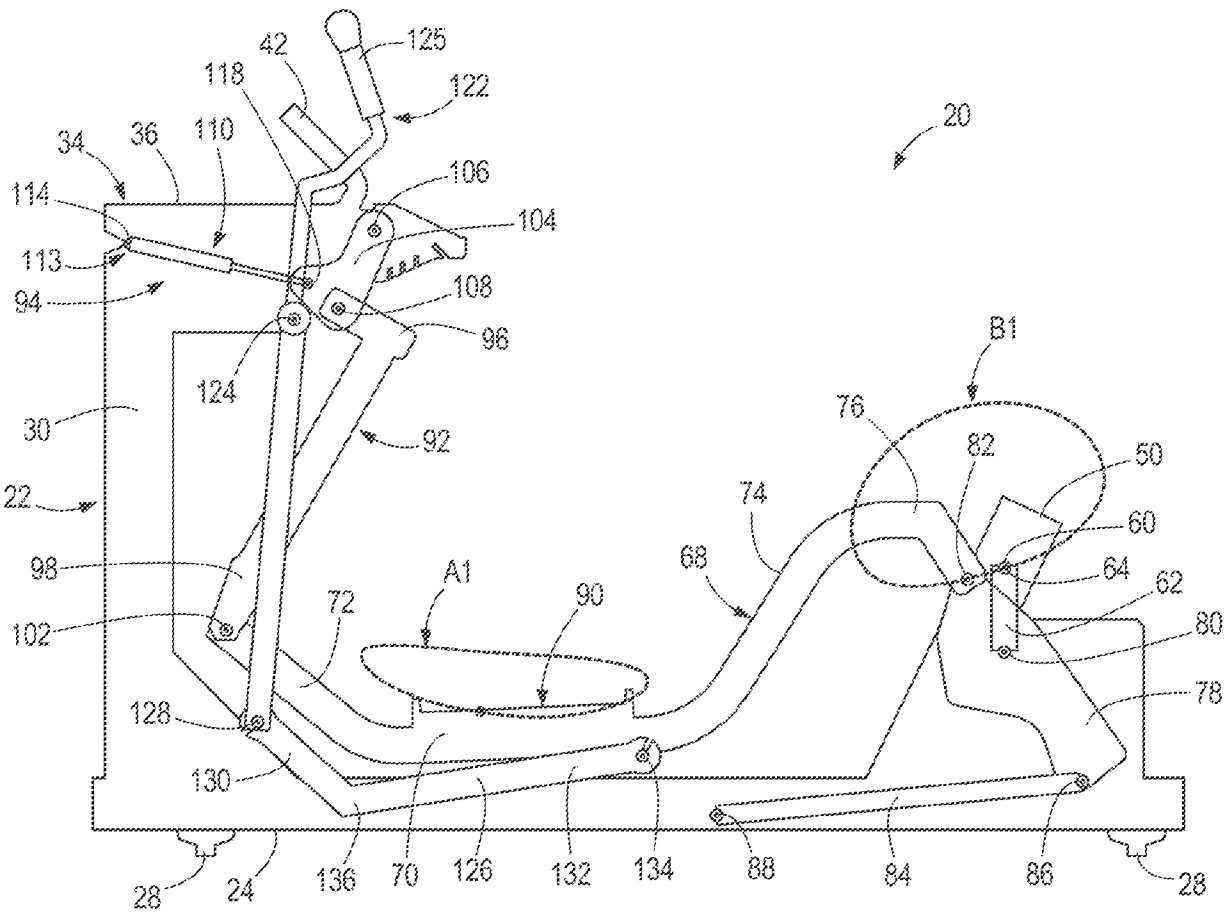
FIG. 8 is a schematic view showing a low incline elliptical path of travel of foot pads on a machine such as that shown in FIG. 1.
Figure 9:
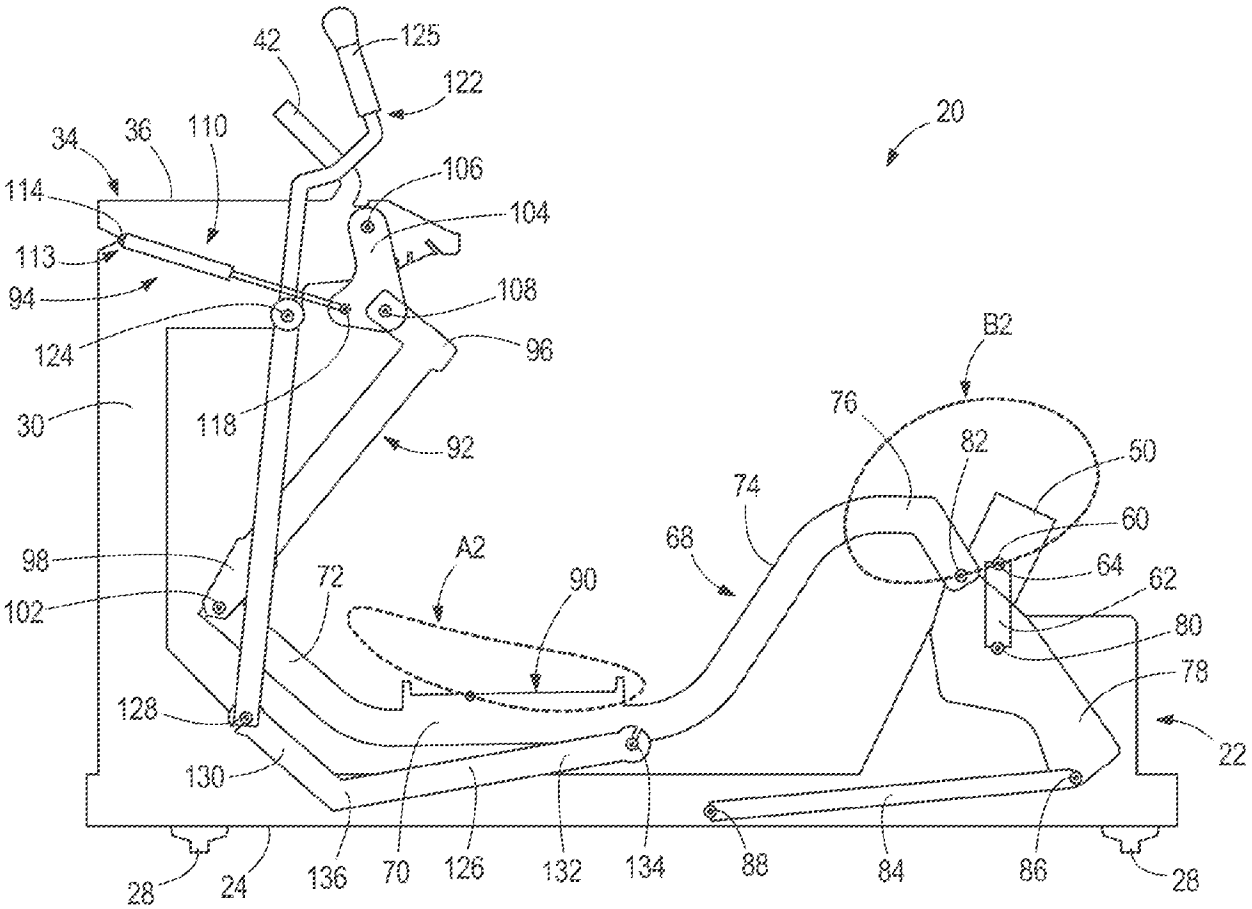
FIG. 9 is a schematic view showing a medium incline elliptical path of travel of foot pads on the machine of FIG. 8.
Figure 10:
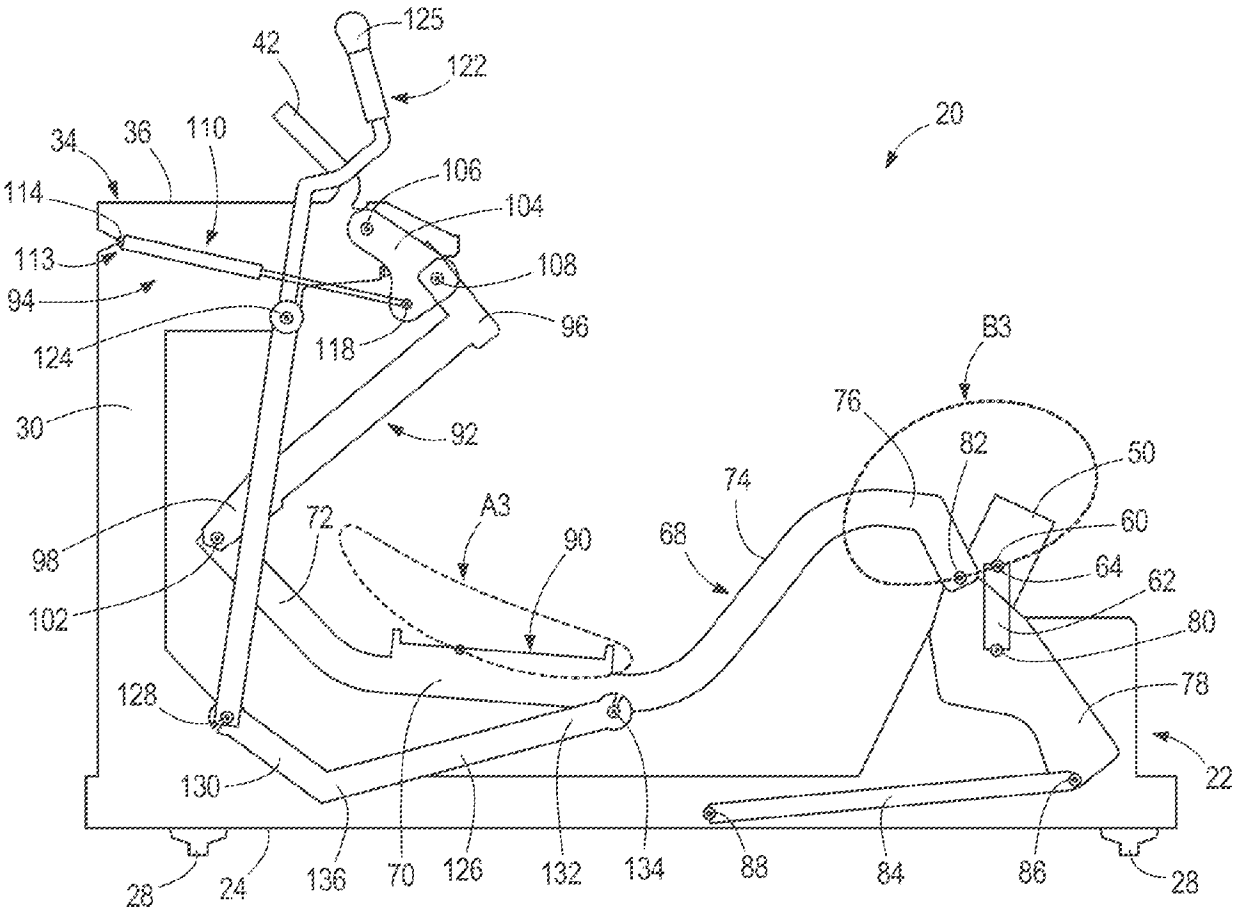
FIG. 10 is a schematic view showing a high incline elliptical path of travel of foot pads on the machine of FIG. 8.

FIGS. 8-10 are schematic views of the machine 20 showing the paths of travel A1-A3 of the foot pads 90 and the paths of travel B1-B3 of the stride link-pedal member pivot axis 82 during low incline (FIG. 8), medium incline (FIG. 9), and high incline (FIG. 10). In each figure, the rocker arms 92 have a different position of swing range, which is determined by position of the incline adjustment device 94.

FIG. 8 illustrates low-incline, where the linear actuators 110 are retracted and thus each incline link 104 is pivoted about the incline link-frame pivot axis 106 towards the bridge d34 (i.e., clockwise about the incline link-frame pivot axis 106 in the side view illustrated in FIG. 8). This moves the incline link-rocker arm pivot axis 108 along an arc towards the bridge 34 and via connection of the rocker arms 92 and pedal members 68, positions the foot pads 90 so as to follow the low-incline elliptical path of travel A1.

FIG. 9 illustrates medium-incline, wherein the linear actuators 110 are moderately extended and thus each incline link 104 is pivoted about the incline link-frame pivot axis 106 away from the bridge 34 (i.e., counter-clockwise about the incline link-frame pivot axis 106 from the side view illustrated in FIG. 9). This moves the incline link-rocker arm pivot axis 108 along an arc away from the bridge 34 and via connection of the rocker arms 92 and pedal members 68, positions the foot pads 90 to follow the medium-incline elliptical path of travel A2.

FIG. 10 illustrates high-incline, wherein the linear actuators 110 are further extended and thus each incline link 104 is pivoted about the incline link-frame pivot axis 106 away from the bridge 34 (i.e., further counter-clockwise about the incline link-frame pivot axis 106 from the side view illustrated in FIG. 10). This moves the incline link-rocker arm pivot axis 108 along the arc further away from the bridge 34 and via connection of the rocker arms 92 and pedal members 68, positions the foot pads 90 to follow the high-incline elliptical path of travel A3. It is important to understand that the three positions illustrated in FIGS. 8-10 are exemplary and other positions are possible via operation of the incline adjustment device 94, which can be automatically controlled by programming of the console 44 and/or by inputs to the console 44 and/or input buttons 48 and/or other input buttons such as on the upper ends of handgrips 125.

By comparison of FIGS. 8-10, the machine 20 is advantageously configured to maintain a substantially compact and constant length (in the length direction L, see FIG. 1) of the paths of travel A1-A3 throughout the adjustments made by the incline adjustment device 94. The configurations of the various components advantageously take up a relatively small footprint. The ends of the rocker arms 92 advantageously do not swing beyond the front of the frame 22, thus maintaining a small footprint. The paths of travel B1-B3 are also substantially constant, due to the configuration of the stride link 78 as illustrated and described herein above. The rear linkage including the stride links 78 advantageously does not swing beyond the rear portion of the frame 22, thus maintaining a small footprint. The configuration of the movable handle members 122 and the coupler link 126 is advantageous in that the overall path of movement (i.e., swing range of the handle members 122 about the handle member-bridge pivot axis 124) is substantially constant despite changes in incline via the incline adjustment device 94.

Advantageously, the foot pads 90 are located on the pedal members 68 at a distance rearward of the rocker arm-pedal member pivot axis 102 to create a more natural, vertical height of the paths of travel A1-A3. This feature in combination with the path of travel B1-B3 yields a more natural, and smooth path of travel A1-A3 in all incline settings. Also, the path of travel (arc) along which the incline link travels, as described herein above, is tilted upward towards the rear portion of travel, towards high incline. This tailors/blends some additional vertical height to the overall ellipse height as it adjusts to a high incline setting.

Figure 11:
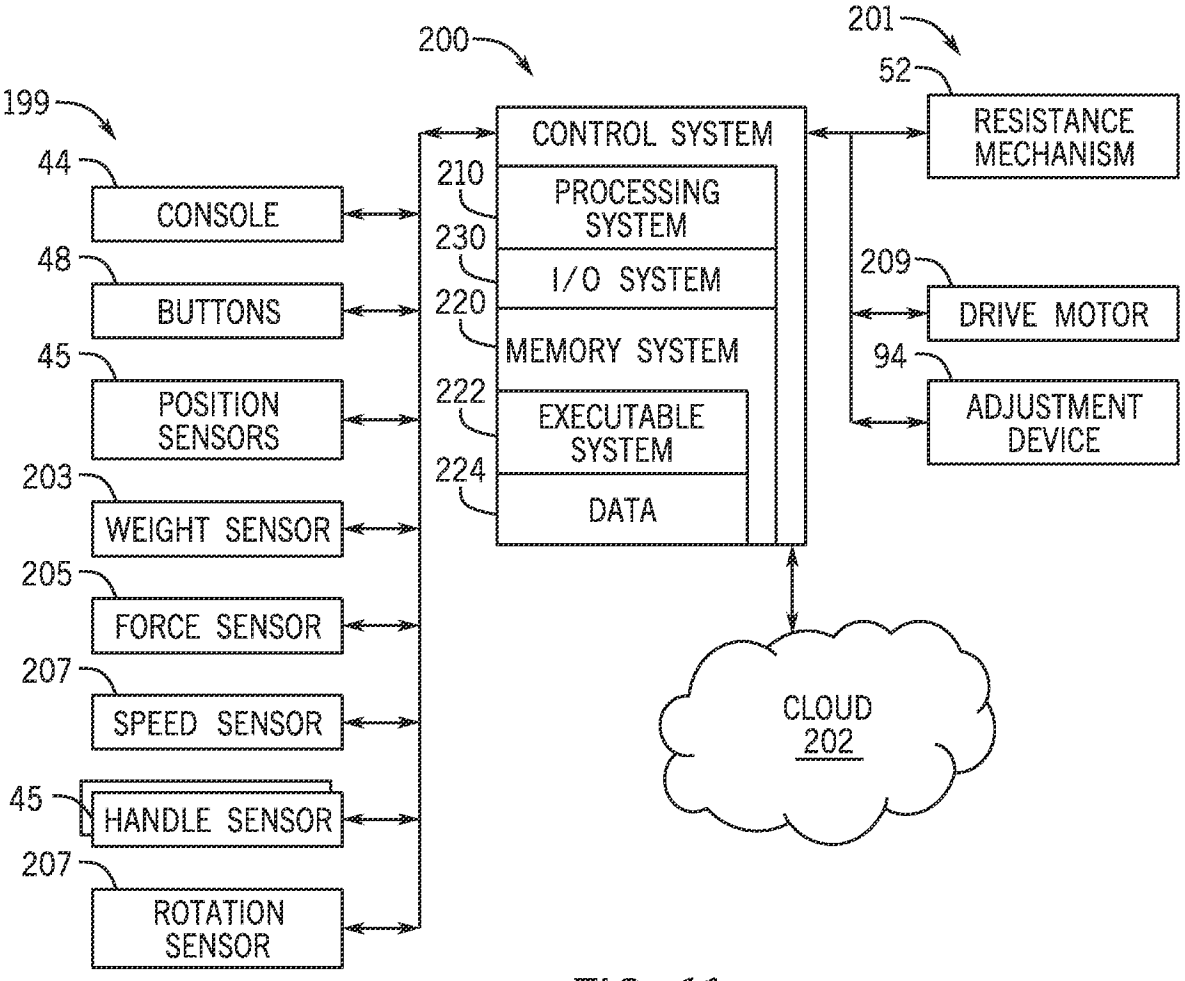
FIG. 11 is a schematic of a control system for controlling an exercise machine according to the present disclosure.

FIG. 11 illustrates one example of a control system 200 for controlling an exercise machine, such as the exercise machine 20 shown in FIGS. 1-5 and discussed above. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 200 communicates with one or more components of the machine 20 via one or more communication links CL, which can be any wired and/or wireless link. The control system 200 is capable of receiving information and/or control signals via the communication links CL to control one or more operational characteristics of the machine 20 and its various sub-systems. It should be recognized that the term "receiving" should not be construed as limiting how the information becomes available to components described herein. By way of example, the present disclosure contemplates both configurations in which the control system 200 is provided the information from another component outside the control system 200, a component within the control system 200 obtains the information from another component outside the control system 200, or a component within the control system 200 derives the underlying information itself. In one example, the communication link CL is a controller area network (CAN) bus. However, in some examples, other types of links are used. It will be recognized that the extent of connections and the communication links CL may in fact be one or more shared connections, or links, among some or all the components in the machine 20. Moreover, lines representative of the communication links CL are illustrated to demonstrate that the various control elements can communicate with one another, and do not represent actual wiring connections between the various elements, nor do they represent the only paths of communication between the elements. Additionally, the machine 20 may incorporate various types of communication devices and systems, and thus the illustrated communication links CL may in fact represent various different types of wireless and/or wired data communication systems.

Figure 3:
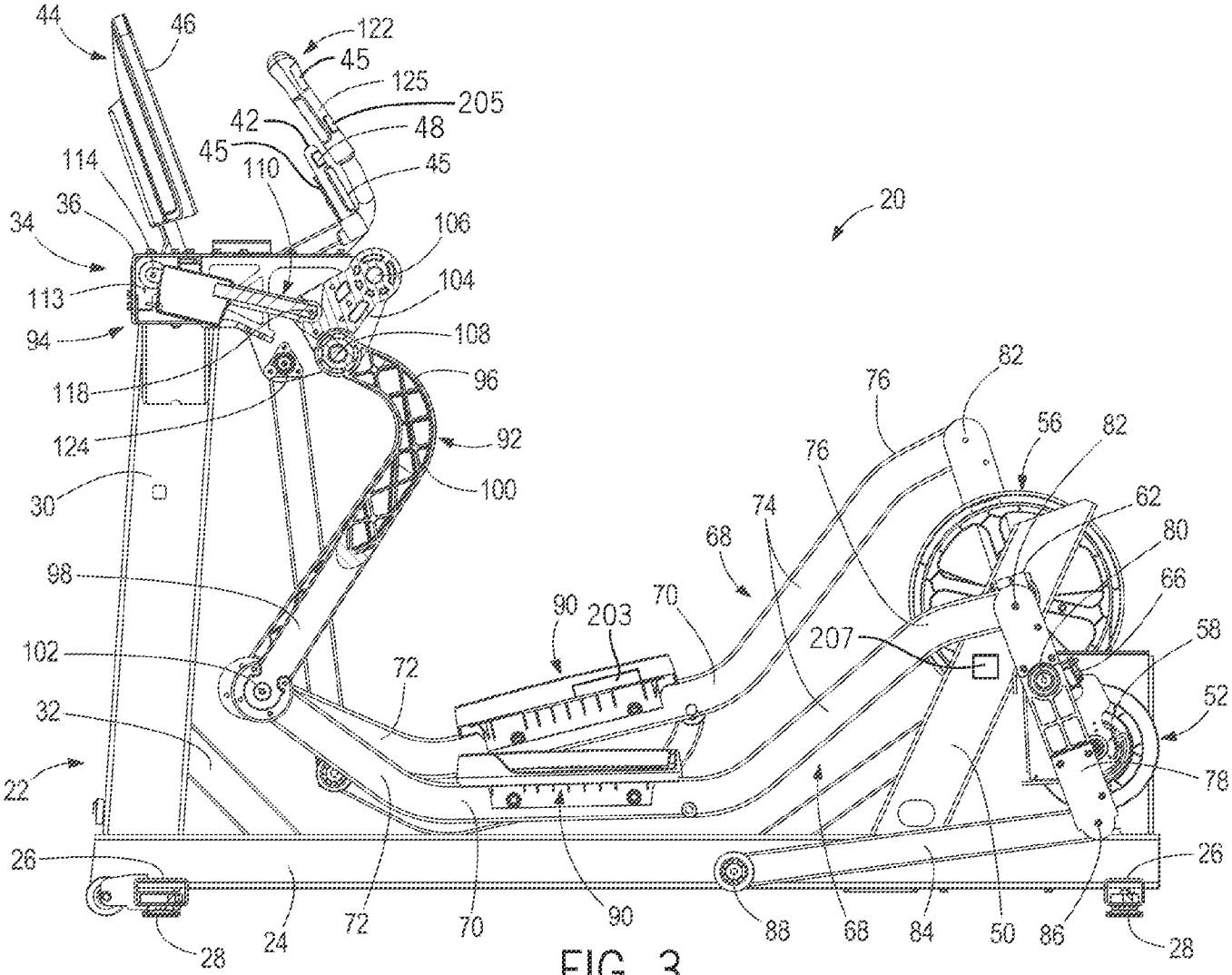
FIG. 3 is a side view thereof having front and rear covers removed.
Figure 4:
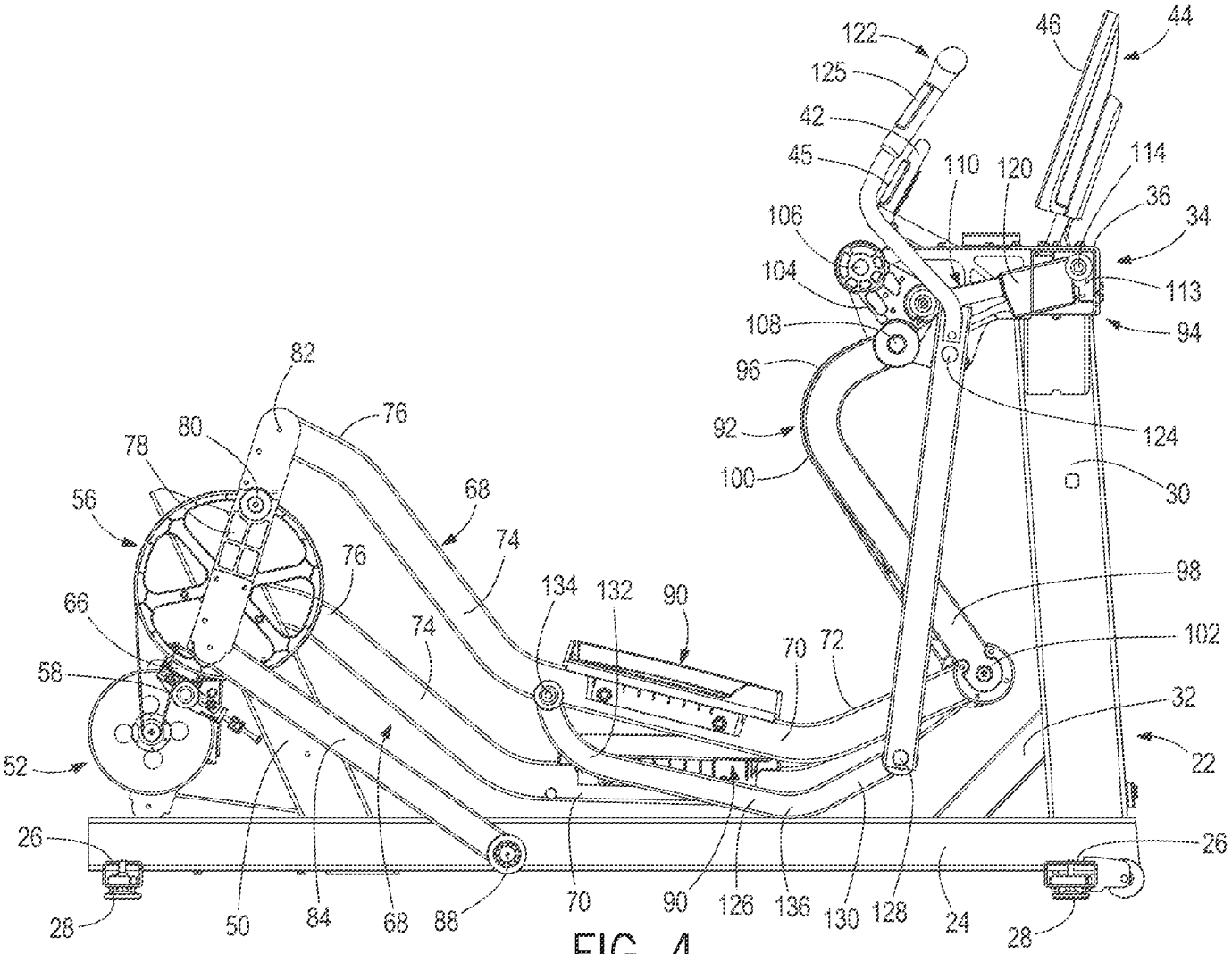
FIG. 4 is an opposite side view thereof having front and rear covers and stabilizer covers removed.
Figure 5:
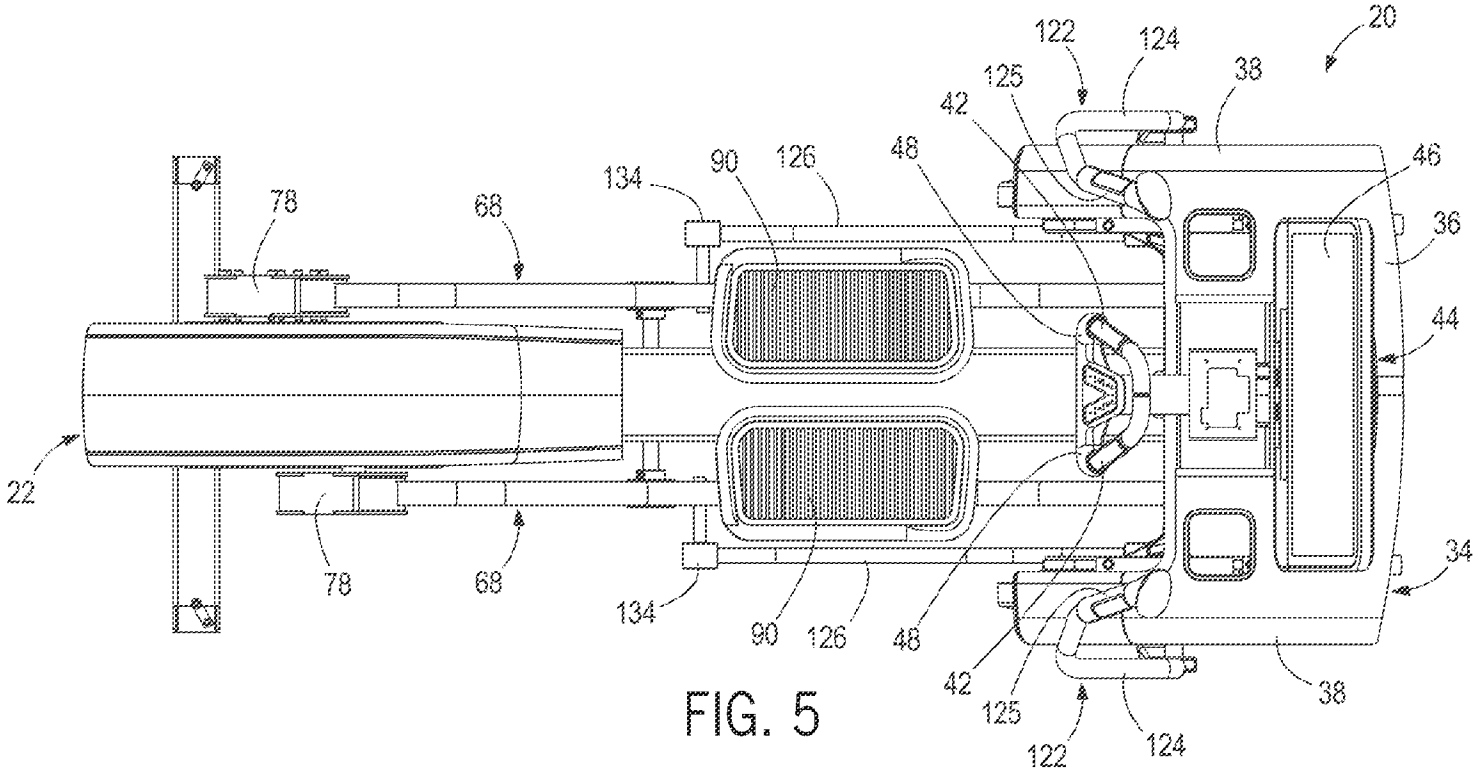
FIG. 5 is a top view thereof having base member and stabilizer covers removed.
Figure 6:
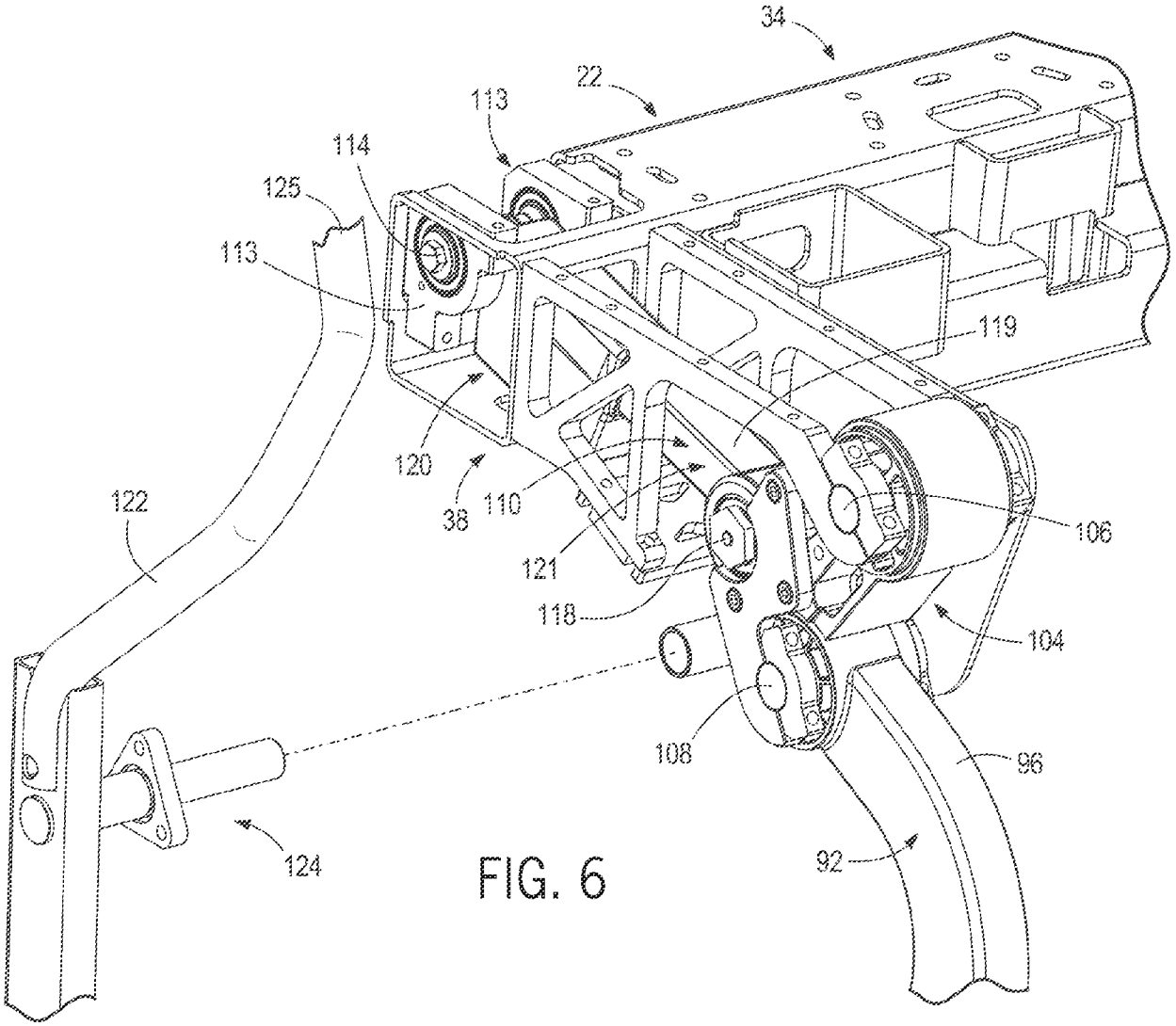
FIG. 6 is an exploded view of portions of the front of the machine.
Figure 7:
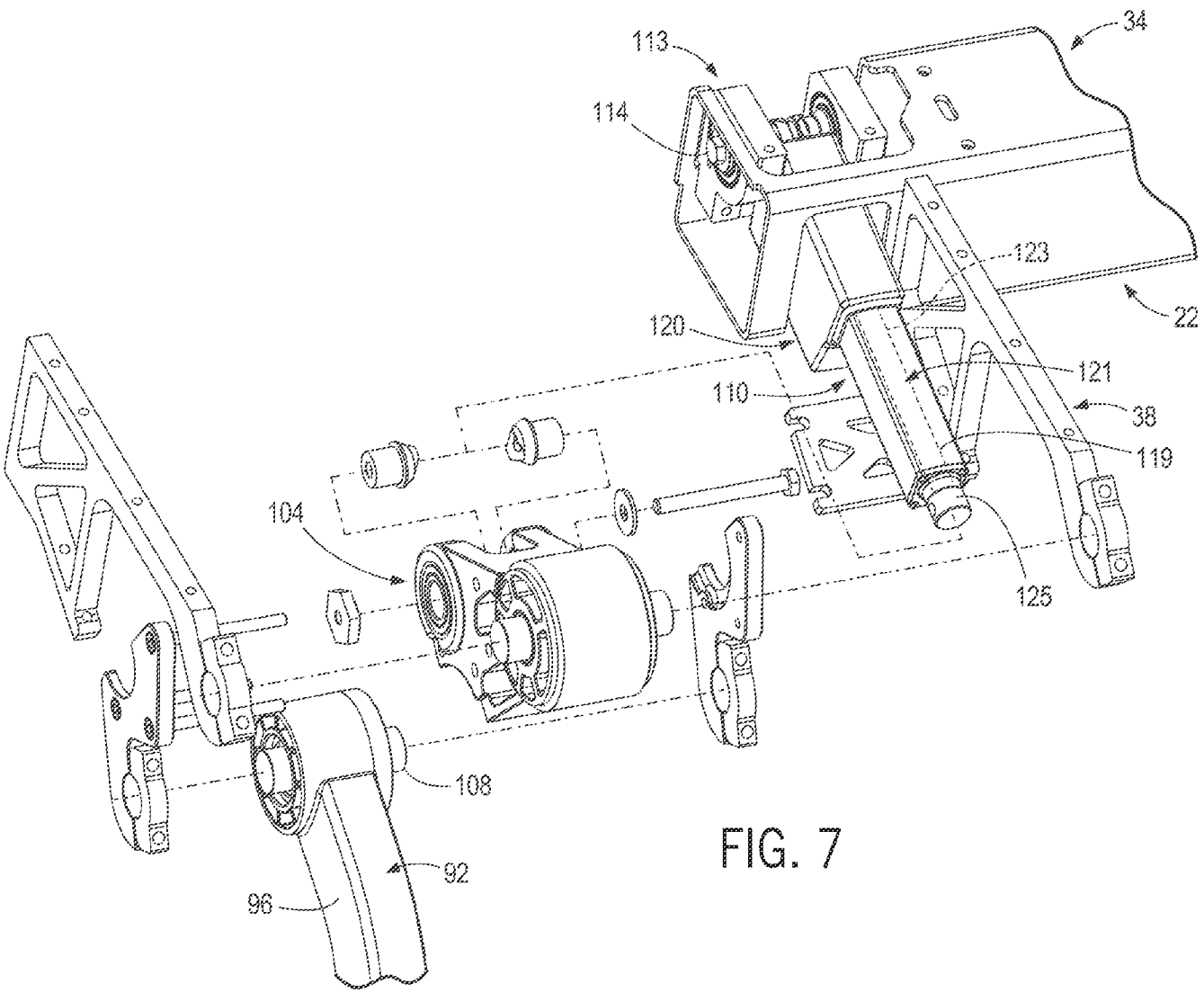
FIG. 7 is another exploded view of the portions illustrated in FIG. 6.

The control system 200 may be a computing system that includes a processing system 210, memory system 220, and input/output (I/O) system 230 for communicating with other devices operatively coupled thereto, such as input devices 199 and output devices 201, either of which can, additionally or alternatively, include elements stored in a cloud 202. The input devices 199 and output devices 201 may also be collectively referred to as peripheral devices. Examples of input devices 199 include the console 44 (e.g., as a touch screen), input buttons 48, and biomechanical, position, or other sensors 45 as discussed above and shown in FIG. 3. Additional inputs 199 may also be provided depending on the type of exercise machine and the various element provided therewith. With reference to FIGS. 3 and 11, a weight sensor 203 may be provided with the exercise machine 20 and configured to measure a weight of the user (e.g., the weight supported via pedals, stairs, or the like). The weight sensor may be a piezo-electric sensor or another technology known in the art. The weight of the user may alternatively be provided by the user, such as a number entry entered via the console 44, retrieved from memory (e.g., the memory system 220 of FIG. 11) such as by logging into a user account via LF Connect or another software application.

The exercise machine 20 may also or alternatively have a pressure sensor or force sensor 205 (e.g., a piezo-electric sensor or another technology known in the art), for example positioned where the weight sensor 203 is shown in FIG. 3, which is configured to measure a force generated by the user while performing the exercise motion. In certain configurations, the same sensor may serve as both the weight sensor 203 and the force sensor 205. For example, one sensor for a manually rotated treadmill may detect a weight when the user is stationary and a force when the user is rotating the belt. In other configurations and for other exercise machines, such as a rowing machine, the force sensor 205 measures forces at a different location or in a different direction than forces caused by the user's weight. In this case, the force sensor 205 may be configured to measure pull forces in the horizontal direction as the user performs the rowing exercise motion, whereas a separate pressure or weight sensor 203 may measure the vertical force of the user's weight on the seat. Another non-limiting example of a location for positioning a force sensor 204 includes the handles of an elliptical cross trainer.

The exercise machine 20 may also or alternatively have a rotation sensor or speed sensor 207 configured to measure a speed in which the user performs the exercise motion, which may be configured in a manner known in the art (e.g., a Hall effect sensor, rotary encoder, etc.). By way of example, the speed sensor 207 may measure rotations per minute (RPM) of rotating portions of an elliptical cross trainer, an RPM or pull frequency for a rowing machine, a number of steps per minute climbed on a stair climbing machine, or other conventionally measured metrics.

With reference to FIGS. 3 and 11, examples of output devices 201 of the control system 200 include the resistance mechanism 52 that controls the resistance for performing the exercise motion and an incline adjustment device 94 for controlling the incline for performing the exercise motion as discussed above. It should be recognized that certain devices may perform functions that are both inputs devices 199 and outputs devices 201, such as the console 44, whereby the screen 46 of the console 44 can be used to both receive inputs from the user and to display information to the user as an output. Other output devices 201 are also contemplated depending on the type of exercise machine and the devices and functions provided therewith. Additional non-limiting examples of output devices 201 include a motor 209 for rotating the belt of a treadmill, lights, sounds, and/or haptic feedback to convey information to the user, cooling fans, and/or other conventionally known elements. Additional information regarding these outputs may be found in the U.S. patents and patent applications incorporated by reference at least in the BACKGROUND section above.

For the control system 200 of FIG. 11, the processing system 210 loads and executes an executable program 222 from the memory system 220, accesses data 224 stored within the memory system 220, and directs the machine 20 to operate as described in further detail below. The processing system 210 may be implemented as a single microprocessor or other circuitry or be distributed across multiple processing devices or sub-systems that cooperate to execute the executable program 222 from the memory system 220. Non-limiting examples of the processing system include general purpose central processing units, application specific processors, and logic devices.

The memory system 220 may comprise any storage media readable by the processing system 210 and capable of storing the executable program 222 and/or data 224. The memory system 220 may be implemented as a single storage device or be distributed across multiple storage devices or sub-systems that cooperate to store computer readable instructions, data structures, program modules, or other data. The memory system 220 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

In this manner, the control system 200 controls the output devices 201 based on the input devices 199 and based on the executable program 222 stored in the memory system 220 to thereby control the exercise machine 20.

As described above, the exercise machines disclosed herein are configured to be used by a user to perform an exercise motion, whereby the exercise machine is operable in multiple use conditions to perform the exercise motion. For example, the exercise machine may have one or more foot pedals and/or handlebars that the user stands on and/or grips, respectively, to perform the exercise movement. In some examples the exercise machine is adjustable to change conditions such as an incline, resistance, stride length, and/or the like to change the user experience in performing the exercise.

For brevity, the "current use condition" of the exercise machine may include any combination of how the user is interacting with the exercise machine, as well as settings of the exercise machine itself. By way of example, these can include configurations and/or settings of the exercise machine (e.g., incline angles, resistance settings, stride lengths or paths, a treadmill operated with a motor driving a belt versus the user driving the belt in a "sled mode", etc.). The current use conditions may also or alternatively include a position or orientation of the user relative to the exercise machine (e.g., sitting versus standing, different grip locations, etc.), how the user is using the exercise machine (e.g., forward versus reverse pedal rotation, whether handles are being used, etc.), a position of the user's foot and/or hand relative to the exercise machine (in certain cases being where a user is contacting the exercise machine), whether the user's hands and/or feet are being used at all for the exercise motion, and/or the like. Each of these current use conditions can be detected based on sensors such as those described above, for example force or pressure sensors, rotation or speed sensors, and the like.

Figure 12:
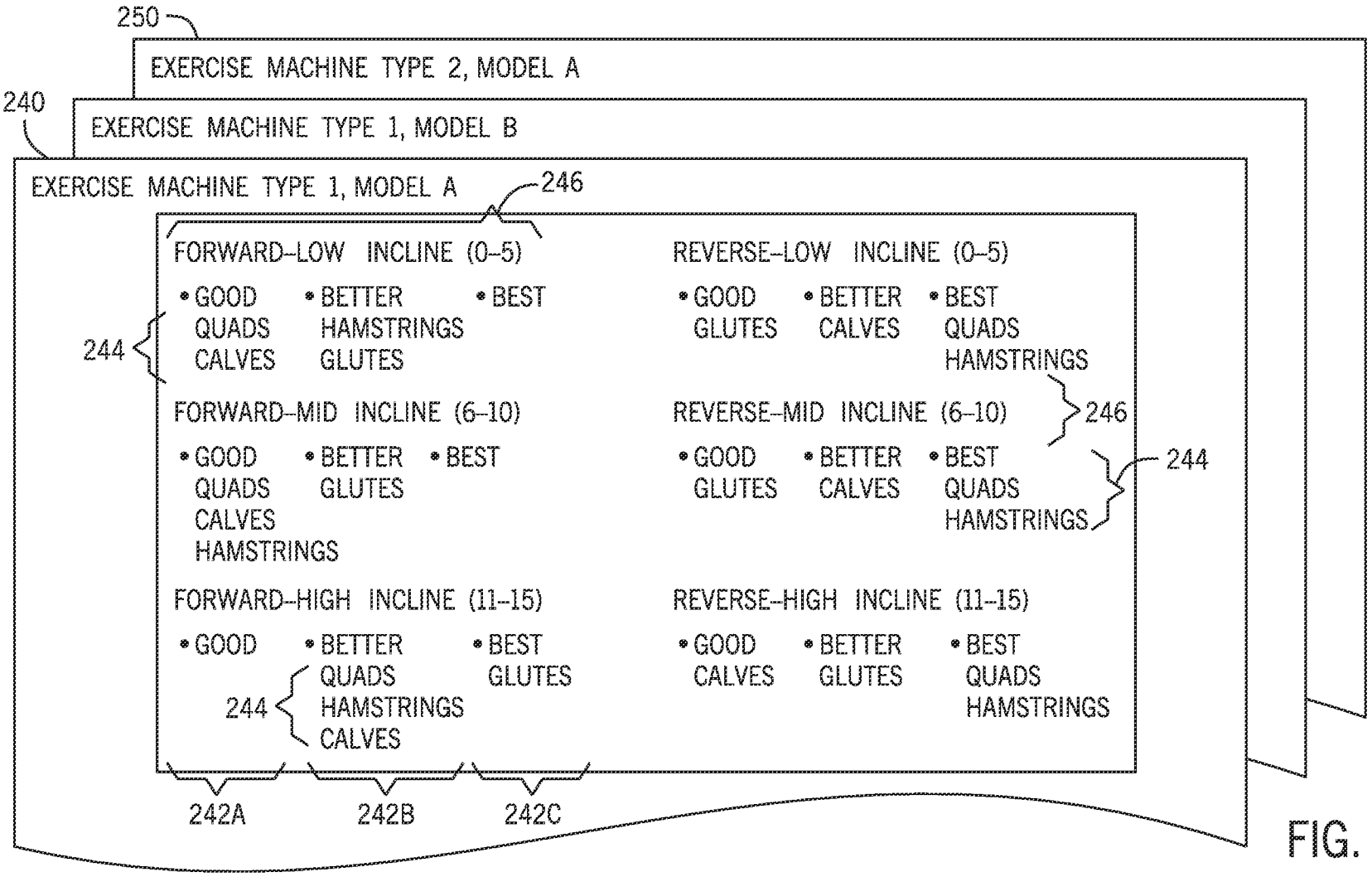
FIG. 12 depicts an example structure for storing data or information for use within a control system such as that shown in FIG. 11.

As discussed above, the present inventors have recognized that the current activation levels for different muscles vary depending on the current use condition in which the exercise machine is operated. With reference to FIG. 11, the control system 200 is operatively coupled to the various sensors and to determine the current activation level of different muscles of the user based on those actual interactions detected by the sensors. The current activation levels of the different muscles for operation within the different the multiple use conditions may be stored for memory in reference (e.g., as a lookup table comprising values determined using empirical data), determined using models, and/or determined using various algorithms. By way of example, FIG. 12 shows a representation of a lookup table 240 that shows different activation levels 242A-C for different muscles 244 as a function of current use conditions 246. For example, when the exercise machine is operated with forward rotation and a low incline, which is categorized here as incline settings between 0 and 5, the current activation levels for the quadriceps or quads and the calves are "good" and the current activation levels for the hamstrings and glutes are "better". In contrast, operating the exercise machine within the same incline range of 0 to 5, but in reverse, provides that the current activation for the glutes is "good", the current activation for the calves is "better", and the current activation level for the quads and hamstrings are "best". It should be apparent that this complexity is more than a typical user would know and understand, and thus demonstrates how easily users may achieve undesirable results via systems and methods known in the art.

Further discussion is provided below regarding the current activation level classifications of "good", "better", and "best". In certain examples, these are determined based on physiological principles and empirical data and represent the relative activation level possible for that muscle. By way of example, data can be collected from a group of test subjects using EMG sensors positioned over the many muscles of interest. The test subjects then perform the exercise motions forward and in reverse, with and without the use of handlebars, in different grip positions, with and without the use of pedals, and/or the like. Likewise, the test subjects perform the exercise motions with different operational settings for the exercise machine, such as changes in incline, resistance, etc. In some cases the data may be normalized based on the activation levels of the different muscles when the exercise is used in a standard manner, such as low or no incline, no resistance, and at an average or customary grip position.

The data collected across these different conditions can then be compared and separated into groupings, for example dividing the different EMG data from a particular glute muscle into a bottom third for "good" activation, middle third for "better" activation, and top third for "best" activation. However, it should be recognized that different divisions are contemplated by the present disclosure, including differing numbers of divisions, uneven divisions, etc., such as the bottom 20% being "low" or "no" activation, the next 50% being "good" activation, the next 10% being "better", and the top 10% being "best". The present inventors have recognized that these activation levels may vary by muscle, exercise machine, and use conditions. Therefore, the different categories and schemes for assigning use conditions to them may be advantageously defined for each type of exercise machine, and in certain cases each model, for the most accurate results. In certain examples, models may be generated by this empirical data so as to define the appropriate categories without needing to manually collect data for each exercise machine and use condition.

The present inventors have recognized that because the incline settings and other settings that impact user interactions with the exercise machine may vary by the particular type, make, and/or model of exercise machines, different datasets may be stored for each of these and referenced in according to the exercise machine being assessed. This advantageously allows a single control system and corresponding program to function across a family of exercise machines, whereby for example lookup table 240 is used for a cross-trainer and lookup table 250 is used for a treadmill.

FIGS. 13-16 depict different user interfaces or displays 300A-D generated to assist a user in targeting a muscle for performing an exercise motion according to the present disclosure, such as via the exercise machine 20 of FIG. 1. The displays 300A-D may be generated on the display screen 46 of a console 44 (FIG. 1), a display of an external device paired to the exercise machine such as a smartphone, tablet, or smartwatch, and/or combinations thereof. As discussed in further detail below, FIGS. 13-16 illustrate how the displays may be used to notify the user and to be engaged by the user to effectuate the settings and/or interactions with the exercise machine to successfully activate a targeted muscle of interest.

Figure 13:
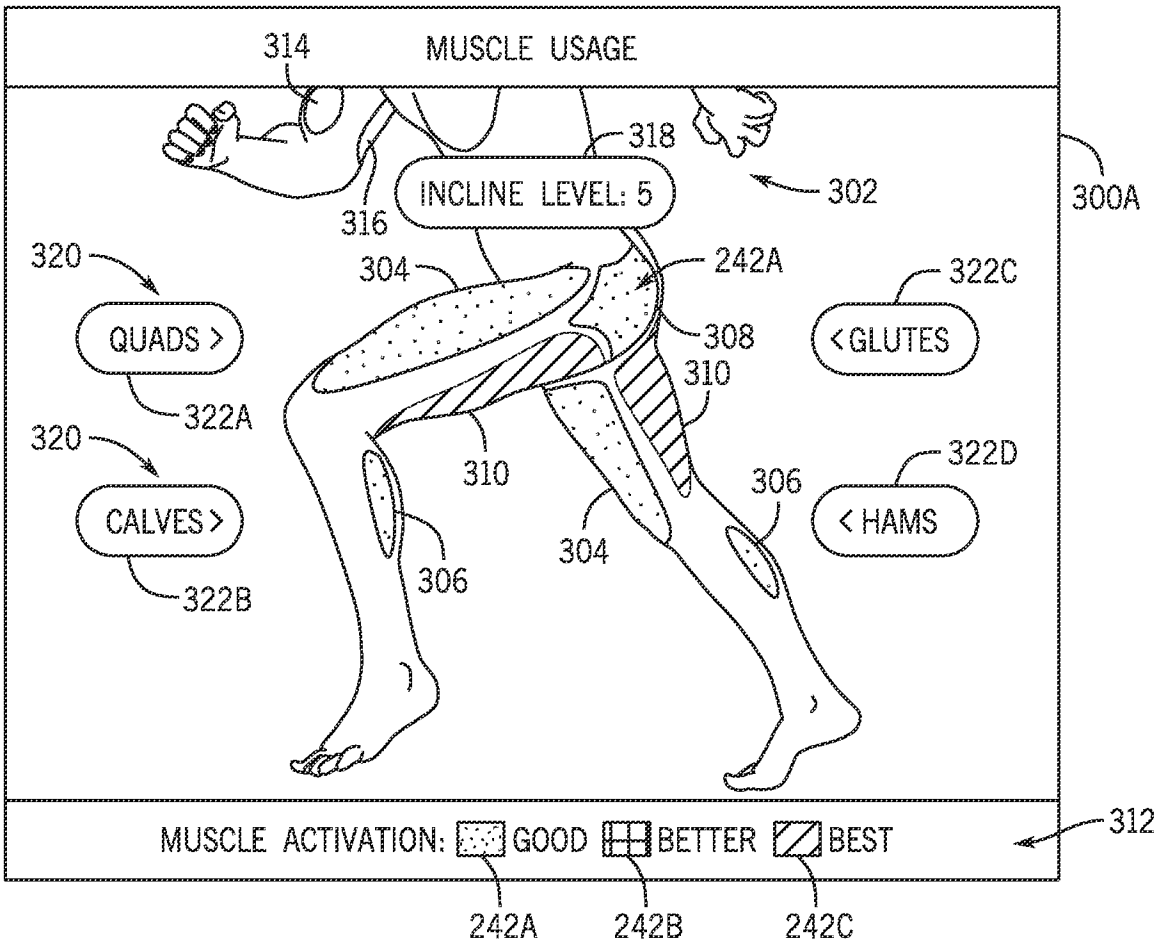
FIG. 13 depicts a first example display for assisting the user according to the present disclosure.

FIG. 13 shows a first display 300A in which a real-time muscle map 302, also referred to as "interactive" map or a muscle "heat map", is generated based on the user's actual interaction with the exercise machine under the current use conditions, which as discussed above also includes an incline of the exercise machine while the user performs the exercise motion. Different muscle groups are graphically depicted in the real-time muscle map 302, in the present example are the quads 304, calves 306, glutes 308, and hamstrings or hams 310. The muscles groups are shown to be in the proper anatomical regions of the real-time muscle map 302, and be of the approximately correct sizes and orientations, to guide the user in correlating these muscle groups to the user's own anatomy. In other words, the real-time muscle map 302 assists the user in identifying the muscle groups without relying on their familiarity with the anatomical names. Other muscle groups may also or alternatively be displayed, such as the biceps 314 and the triceps 316, the activations of which may be modified by use of handles (for example), but are not discussed further in the present example.

Each of the muscle groups 304, 306, 308, 310 is depicted with a visual appearance that indicates the current activation level of that muscle based on the current use condition detected for the user by the one or more sensors as discussed above. In the example shown, the indications of the current activation levels are indicated to correspond to "good", "better", or "best" relative categories of activation levels (242A-242C), as discussed above with respect to the data shown in FIG. 12. These categories may be distinguished by color, pattern (as shown), brightness, duty cycles of flashing, or other discernable differences.

A legend or key 312 is shown on the bottom for the user to identify the category depicted for each muscle. The display 300A shows that the current activation level for the glutes 308 is currently "good"; however, this is the lower of the 3 relative activation categories. Therefore, the display 300A is beneficial in informing the user of this current activation level, whereby the user may be intending to work out the glutes at a higher activation level (also referred to as a "desired" activation level). The display 300A also displays a current use information 318 for the user operating the exercise machine, here displaying an incline level of 5 (which may have been selected in a conventional manner, such as via buttons near the console).

Above and beyond the advantages of clearly informing the user of the true and current activation level for their target muscle, the display 300A also provides mechanisms for further assisting the user in achieving the desired activation level of their target muscle. In particular, the display 300A includes buttons 322A-D corresponding to the quads, calves, glutes, and hams, respectively, with which the user may select or input the desired activation level for a specific target muscle. The buttons may be soft buttons via a touchscreen, or other mechanisms known in the art. In certain example, each of the buttons 320 corresponds to selecting a maximum possible activation level as the desired activation level for that corresponding muscle. For example, selecting button 322C for "glutes" may be received by the control system as the user selecting a desired activation level for the glutes to be the maximum possible activation level, here the "best" category.

Once the control system receives the desired activation level of the muscle to be targeted, the exercise machine automatically effectuates changes to exercise machine and/or the user's use thereof, and/or coaches the user in how to do so to achieve the desired activation level for that muscle. This may comprise determining a recommended use condition with actions for the user to take and/or automatic changes to the operation of the exercise machine that would cause the muscle to be at the desired activation level for performing the exercise motion. By way of example, the recommended use condition may include whether the user should grasp handlebars, and in which region thereof, a change to the incline of the exercise machine, and/or a change in the direction in which the user is performing the exercise motion.

By notifying the user how to change their usage and/or automatically causing the exercise machine to operate in particular manner, the exercise machines and methods for controlling them as discussed herein thereby assist the user in targeting the muscle for performing the exercise motion.

In certain examples, the exercise machine incorporates a braking mechanism (as discussed above, which may be control of a motor) to not permit the user to continue performing the exercise motion in the direction that does not correspond to the recommend use condition, assisting the user in understanding the changes required to meet their objectives.

Returning to the example of FIG. 13, in certain examples if the user selects the glute button 322C, the control system notifies the user to change the incline to be within the range of 11-15 in accordance with the table 240 of FIG. 12. In further examples, the display will particularly notify the user to change the use of the exercise machine to provide the maximum possible activation level, such as coaching the user to change the incline to specifically 15 rather than the range of 11-15. The display may be configured such that the real-time muscle map 302 still shows the actual, current activation level of each muscle even if a different, desired activation level has been selected by the user but not effectuated. In other words, changes to the muscle map 302 are provided only when changes to the current use conditions result in changes to the current activation levels, which as stated above are based on the readings of the various sensors.

Figure 14:
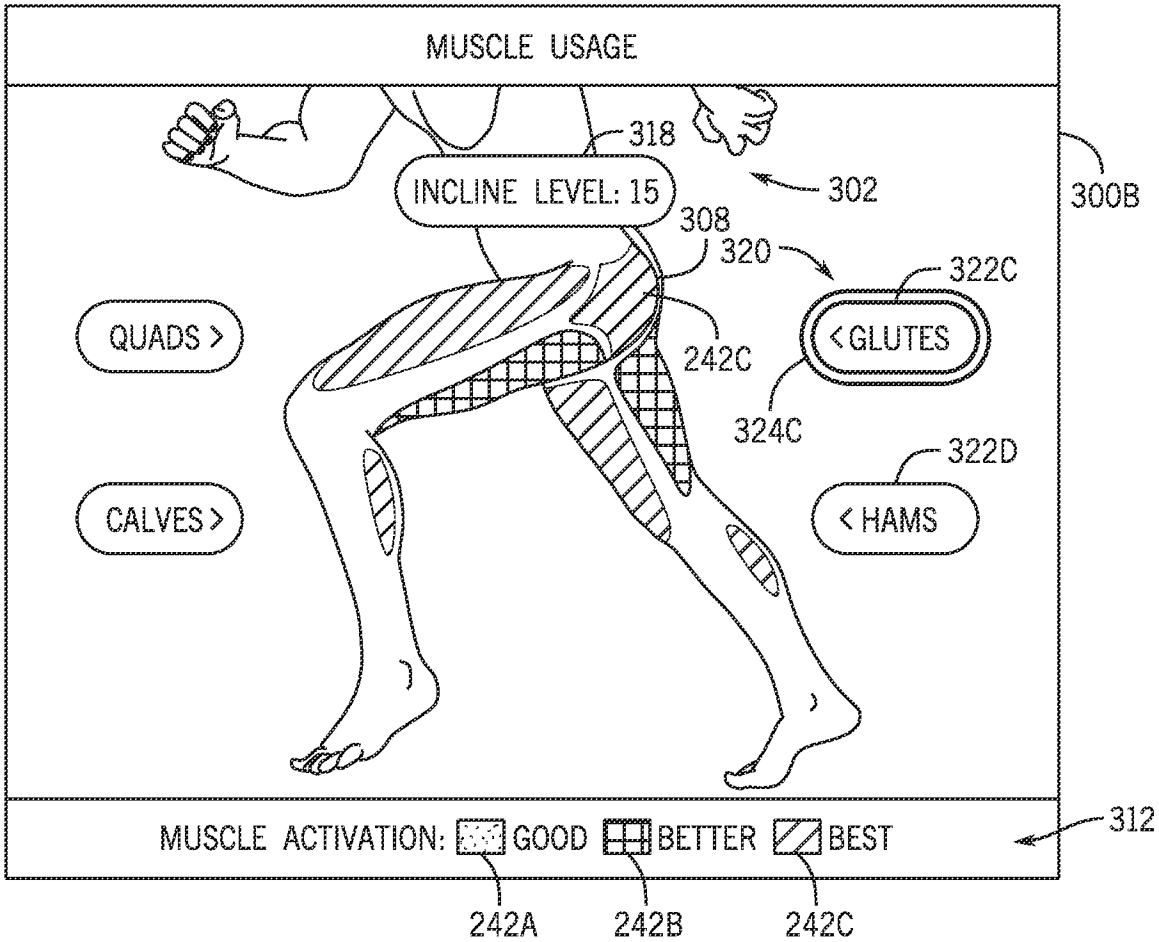
FIG. 14 depicts a second example display for assisting the user according to the present disclosure.

In other examples, such as that shown in FIG. 14, when the user selects the glute button 322C, the control system automatically causes the exercise machine to operate in the recommended use condition that would provide the desired activation level of the target muscle, here the glutes. In other words, the recommended use condition is that which would require the target muscle to be used at the desired activation level to perform the exercise motion. In this case, the exercise machine has automatically increased the incline to 15, as indicated in the current use information 318. As can be seen, the glutes 308 are now depicted in the real-time muscle map 302 to have a "best" current activation level 242C, in contrast to being "good" before the change. In this manner, the user simply selecting the desired activation level for their target muscle of interest automatically causes the exercise machine to provide this effect, which the user can easily confirm to be the case via the updated real-time muscle map 302. The current activation levels of other muscles are also shown to have changed accordingly.

In certain examples, when the exercise machine is being used such that the target muscle is maximally activated, this is indicated on the display, such as via the particular depiction of the button 320 associated with that target, e.g., by showing the button 320 having a thicker border 324C as compared to before, or as compared to other buttons 320. Using the previous example of automatically increasing to an incline of 15, if the user were to manually decrease the incline of the exercise machine to level 14, the current activation of the glutes would remain in the "best" category since this corresponds to levels 11-15. However, the current use information 318 may change to display a "14" and the border 324C around the glute button 322C may change (e.g., disappear, become thinner, stop flashing, change colors, etc.). The present inventors have recognized that because the various muscles work differently, increasing the desired activation level of a given muscle does not always mean increasing the incline, for example. This makes the task of a user targeting a muscle group of interest even more challenging with presently known systems, whereby it can be unintuitive for the user to decrease or reduce an incline for increase muscle activation, for example for targeting calves when pedaling a cross-trainer in reverse.

Figure 15:
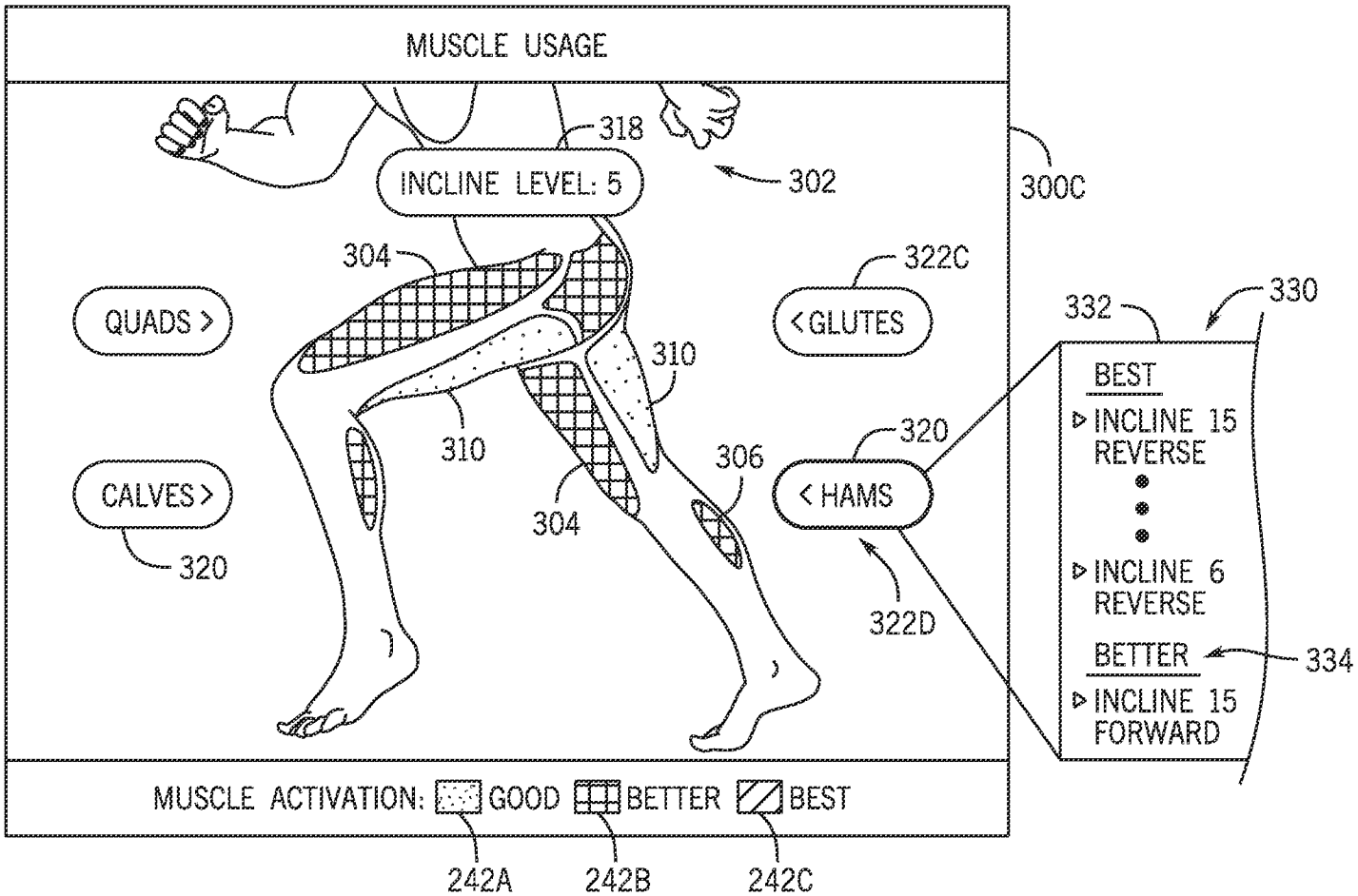
FIG. 15 depicts a third example display for assisting the user according to the present disclosure.

In certain examples, such as that shown in FIG. 15, selecting a button 320 does not necessary automatically correspond to selecting the maximum possible activation level as the desired activation level for that muscle. Instead, selecting a button 320 opens a submenu 330 of options, providing the user with more control in choosing the desired activation level and how they would like to achieve it. For example, the submenu 330 of FIG. 15 is shown to have different best options 332 that would each provide the "best" category for activation of that muscle, different better options 334 that would each provide the "better" category for activation of that muscle, and so on. If using the example data of FIG. 12, the user operating the exercise machine in reverse results in the "best" category of activation of the hamstrings, regardless of incline level. The user can also see via the submenu 330 that if they wish to continue operating in a forward motion, the highest possible activation level for the hamstrings would be "better", and only if the inline remains in the 11-15 range (not currently visible in the submenu 330, see FIG. 12).

Figure 16:
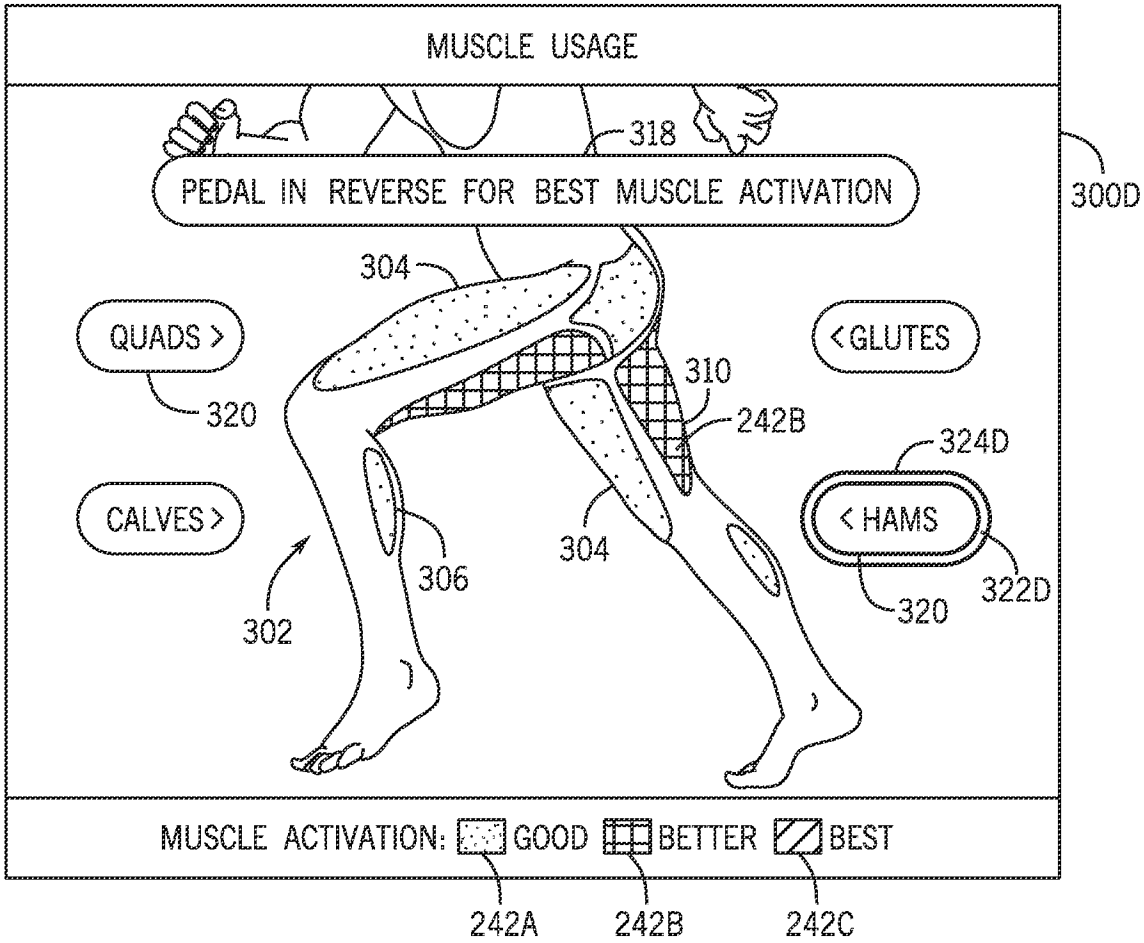
FIG. 16 depicts a fourth example display for assisting the user according to the present disclosure.

Selecting the hams button 322D in FIG. 15, and the highest option of the submenu 330 for the "best" activation (i.e., an incline of 15 and operating in reverse) would cause the control system to transition the display device to generating the display 300D of FIG. 16. In this case, the exercise machine has automatically transitioned the incline to level 15 as requested. The display 300D shows that the activation level of the hams 310 in the real-time muscle map 302 to have increased from a "good" activation level 242A to a "better" activation level 242B. However, because the best activation level also requires operating in reverse, the display 300D shows the current use information 318 acting as a notification to the user recommending that they change their actual use with the exercise machine to correspond to pedaling in the reverse direction. This is also referred to as displaying exercise motion instructions for the user. Since the exercise machine has otherwise changed the other aspects of the current use conditions to provide the desired activation level for the target muscle of interest (i.e., here by changing the incline), but the user has not yet modified their own interaction to achieve this result, the border 324D of the ham button 322D is displayed to indicate that the current activation level is not currently meeting the desired objective, here by flashing or being shown in broken lines. The current use information 318 may also flash and/or the like to further assist the user in identifying and executing the necessary change in their use of the exercise machine to achieve the desired activation level they seek.

Figure 17:
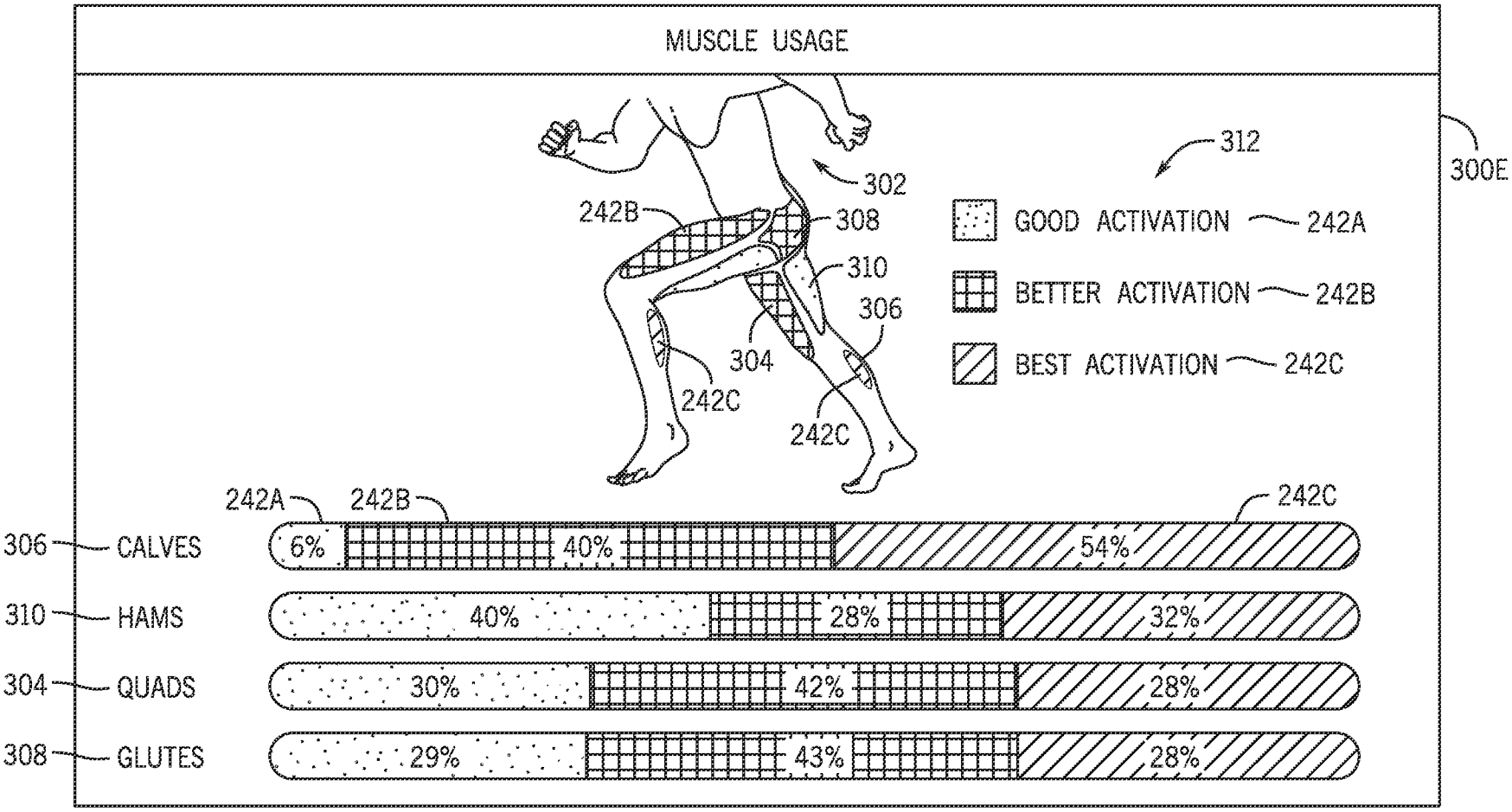
FIG. 17 depicts a fifth example display for assisting the user according to the present disclosure.

The control system is further configured to record the current activation level of each muscle group over time, which can be used to show the activations levels for different muscles over an entire workout session or another period. FIG. 17 shows a summary display 300E that depicts what percentage of the time period of interest each muscle group was engaged in each of the activation levels. The time period may be the entirety of a completed workout, a selectable period of time (e.g., the last week), or other periods. The display 300E of FIG. 17 shows that the calves were in a "good" activation 6% of the time, "better" activation 40% of the time, and "best" activation 54% of the time. The muscle map 302 is also shown to depict each muscle with whichever activation level received the greatest percentage of the time. For example, the calves were in the "best" activation category more than any other (54%) and are thus depicted as such, whereas the quads are shown in their longest duration category of "better" activation at 42%.

Figure 18:
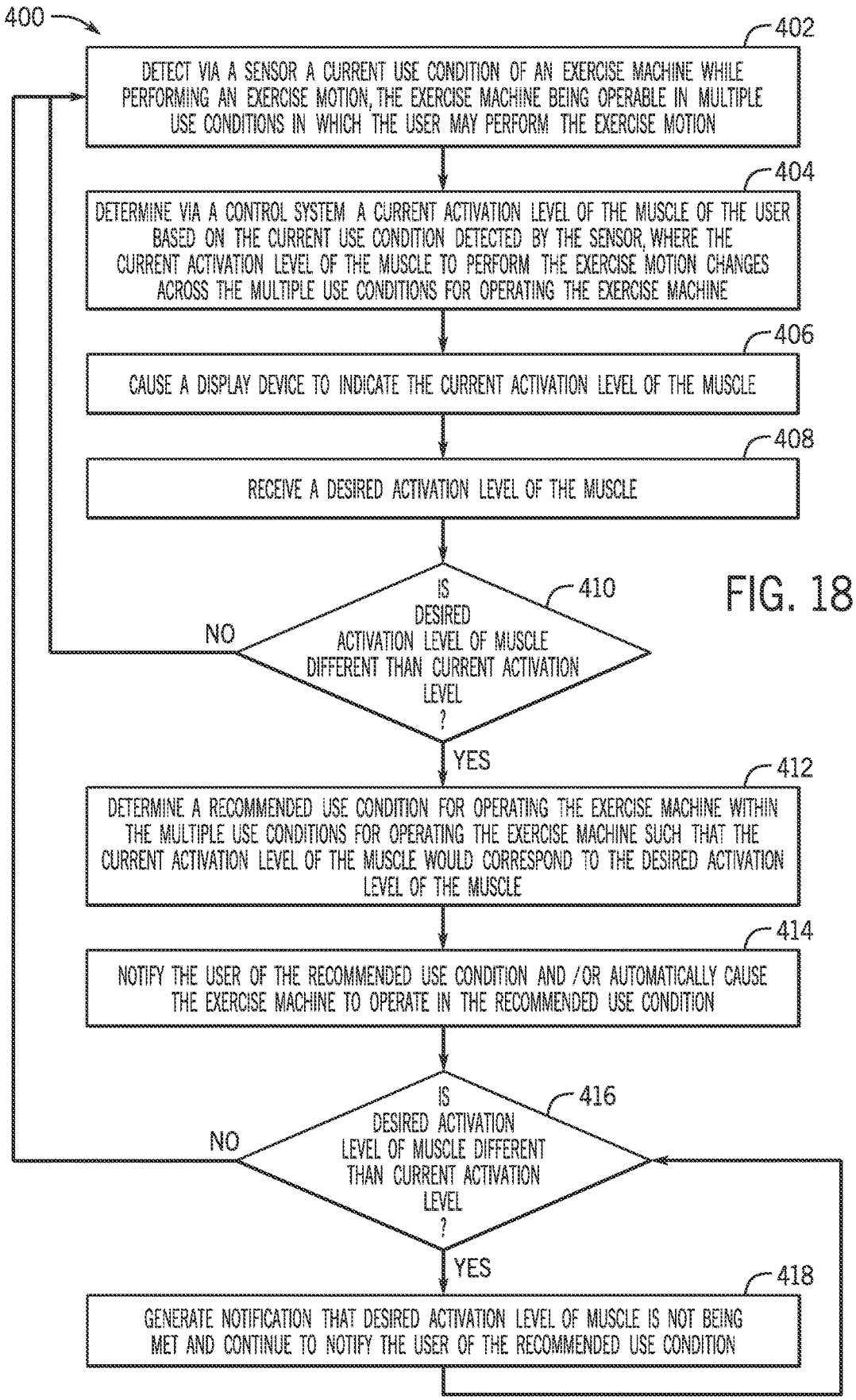
FIG. 18 is a flow chart illustrating a first example of a method for controlling an exercise machine according to the present disclosure.
Figure 19:
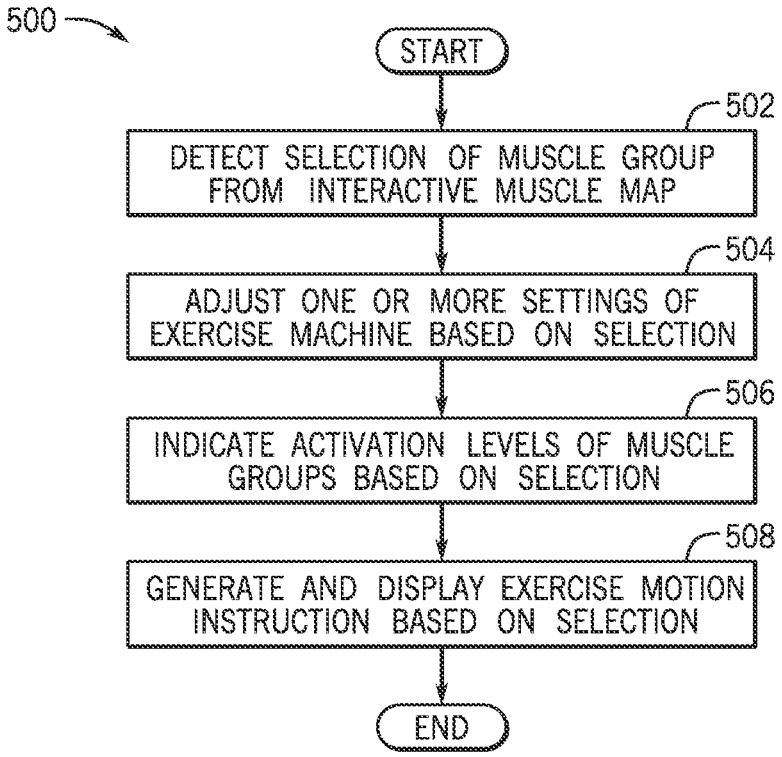
FIG. 19 is a flow chart illustrating a second example of a method for controlling an exercise machine according to the present disclosure.
Figure 20:
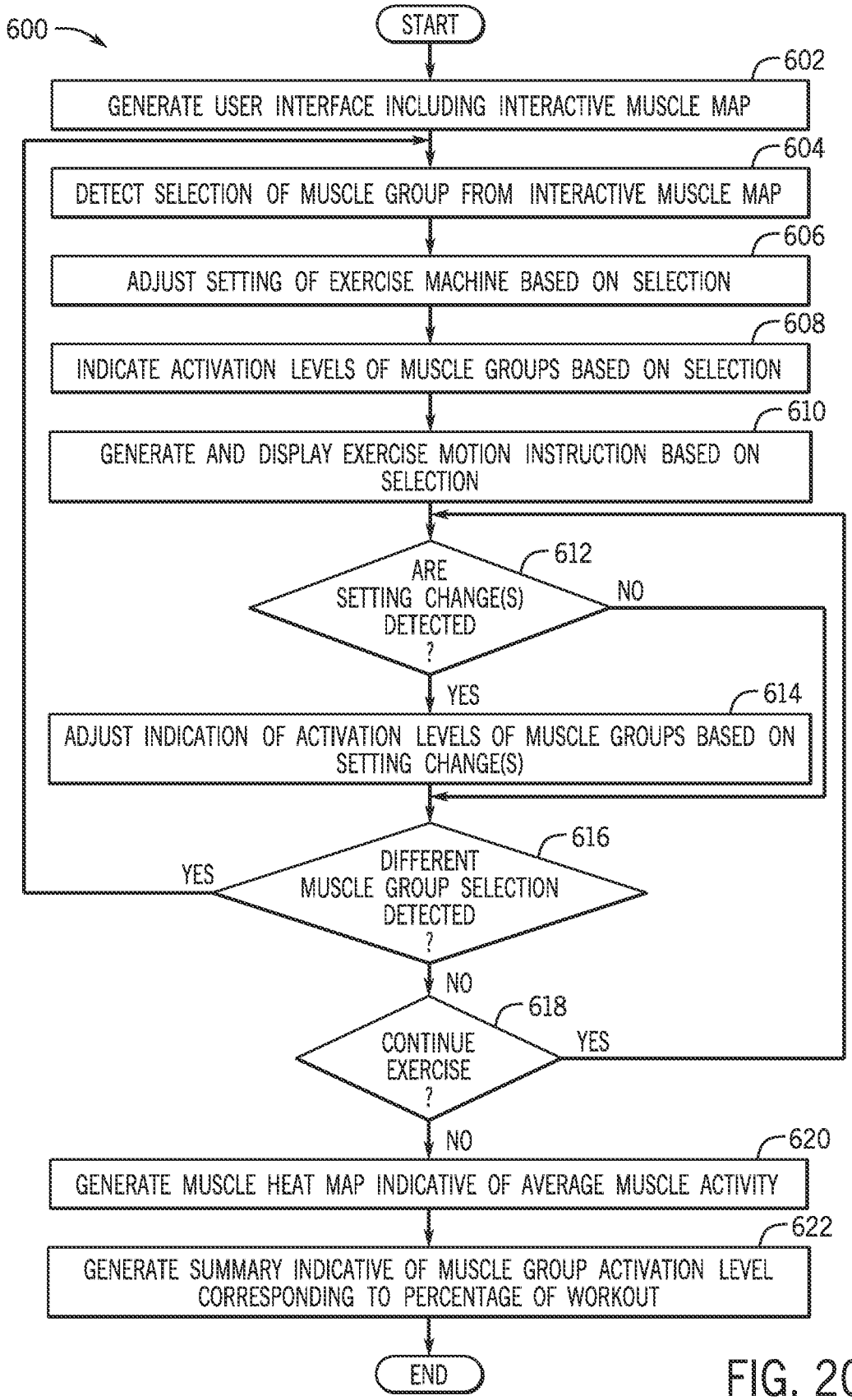
FIG. 20 is a flow chart illustrating a third example of a method for controlling an exercise machine according to the present disclosure.

FIGS. 18-20 provide examples of methods for controlling exercise machines to assist users in targeting muscles for performing exercise motions, which may be controlled using displays such as that shown in FIG. 13, or other mechanisms contemplated by the present disclosure. The method 400 of FIG. 18 includes in step 402 detecting via a sensor a current use condition of an exercise machine while performing an exercise motion, whereby the exercise machine is operable in multiple use conditions in which the user may perform the exercise motion as discussed above. Step 404 provides for determining via a control system a current activation level of the muscle of the user based on the current use condition detected by the sensor, where the current activation level of the muscle to perform the exercise motion changes across the multiple use conditions for operating the exercise machine. Step 406 provides for causing a display device to indicate the current activation level of the muscle, which as described above may be performed by changing the visual appearance of different muscles within a real-time muscle map.

Step 408 provides for receiving a desired activation level of a muscle being targeted, which for example as discussed above may be performed by receiving a user selection via a touch screen display of a soft button corresponding to that muscle group. It should be recognized that this may also or alternatively be performed in other manners, such as by selecting a muscle group on a connected external device such as a smartphone or smartwatch, via audible commands provided by the user to the exercise machine, or others. Step 410 then determines whether the desired activation level of the muscle is different than the current activation level of that same muscle. If not, the process returns to step 402. However, if in step 410 it is determined that the desired activation level of the muscle is different than the current activation level, the process continues to step 412.

Step 412 provides for determining a recommended use condition for operating the exercise machine within the multiple use conditions for operating the exercise machine such that the current activation level of the muscle would correspond to the desired activation level of the muscle received in step 408. This may be determined with reference to lookup tables, use of algorithms, use of models, or other mechanisms, as described above. In other words, step 412 provides for determining the settings and or other modifiable operating conditions of the exercise machine, as well as the users use of the machine, including whether to use arms, whether to use legs, where to grip handlebars, where to position feet on pedals, where to manually make adjustments to such features as adjustable stride length settings, and or other changes impacting the activation level of muscles in performing an exercise motion.

Step 414 then provides for notifying the user of the recommended use conditions and/or automatically causing the exercise machine to operate in the recommended use conditions determined in step 412. As discussed above, step 414 may be a combination of the exercise machine automatically changing certain parameters such as incline, and also coaching the user to make the necessary manual adjustments that will yield the desired activation level of the muscle being targeted.

Step 416 then determines whether the desired activation level of the muscle is different than the current activation level. If not, the process returns to step 402. If so, step 418 provides for generating, or continuing to generate, notifications to the user that the desired activation level the muscle is not being met and thus the method provides for continuing to notify the user of the recommended use conditions necessary to achieve the desired activation level. The process may iterate by returning to step 416 until the desired activation level of muscle is not different than the current activation level. In certain examples, a timeout function is further included so if the user has not made the necessary changes such that the desired activation level is the current activation level after a certain period of time (e.g., 30 seconds, 1 minute, 3 minutes, 5 minutes), the notifications will cease so as to not become a nuisance for the user.

FIG. 19 depicts a method 500 for also assisting a user in targeting a target muscle for performing an exercise motion according to the present disclosure. Step 502 provides for detecting a selection of a muscle or muscle group from an interactive muscle map, which may be performed in a manner such as described above, for example using a touch screen display with a real-time muscle map depicting the individual muscles available for selection. Step 504 provides for adjusting one or more settings of the exercise machine based on that selection, which is described above may be performed by modifying an incline, resistance, stride length, stride path, or other modifiable settings for the exercise machine. Step 506 provides for indicating the activation levels of the different muscle groups based on the selection from step 502. In other words, step 506 provides for indicating for the user how the activation levels of the muscles changed based on the adjustments made in step 504. Step 508 then provides for generating and displaying exercise motion instructions to the user based on the selection of step 502 as necessary to provide optimal exercise for the selected muscle group. As described above, this may include changing a position in which the user is gripping handlebars, pedaling in reverse, or other instructions for how the user should change their interaction with the exercise machine.

FIG. 20 depicts a method 600 for also assisting a user in targeting a target muscle for performing an exercise motion according to the present disclosure. Step 602 provides for generating a user interface that includes an interactive muscle map such as those described above. Steps 604 to 610 may proceed in a similar manner to steps 502 to 508 as described above, and thus for brevity are not repeated here. Step 612 then provides for determining whether the setting changes have occurred, which may include the requested setting changes of the exercise machine and/or the requested changes in the user's interaction of the exercise machine. For example, this may include detecting the actual incline of the exercise machine to ensure that the change took place. This may also or alternatively include detecting that a user's hand position has changed on the handlebar, that the user is sitting or standing on a seat, and/or that the user has started using handlebars at all, to determine whether the exercise motion instructions provided in step 610 have been followed. If settings changes are determined to have occurred in step 612, step 614 provides for adjusting an indication of the activation levels of the muscle groups based on these setting changes. In other words, if the setting changes have occurred, the current use conditions have changed, and the activation levels of the muscle groups are updated to indicate these changes. After step 614, or if step 612 is determined in the negative, the method continues with step 616, which determines whether different muscle group selections have been detected, for example the following a similar process to step 604. If yes, the method returns to step 604. If not, the method continues to use step 618, which determines whether exercise has continued. If yes, the process returns to step 612. If not, step 620 provides for generating a muscle heat map indicative of the average muscle activity. This may be similar to the summary depicted in HG 17 and described above or may be a simplified version that rather than indicating activity levels as a percentage of time simply shows the average activation level for each muscle, similar to the real-time muscle map 302 shown in HG 17. Step 622 then provides for generating a summary indicative of the muscle group activation level corresponding to a percentage of the workout, which is described above may be performed in a manner similar to that shown in FIG. 17.

The present inventors have further identified that the concepts disclosed herein may be advantageous for building a custom workout routine to provide different desired activation levels for different target muscles for different periods of time. For example, the user may intentionally set up a workout that will provide the results shown in FIG. 17, which yields different activation levels for different percentages of the overall workout. The concepts disclosed herein may also allow a user to build a custom workout routine to provide desired activation levels for different target muscles for the same periods of time. For example, the user may intentionally set up a workout that will result in a "best" activation level for each muscle group (e.g., quads, hams, calves, and glutes) for equal portions (e.g., 25% each) of the workout. In this manner, the presently disclosed concepts provide customized control of the precise level of activation for each muscle group that has not previously been knowable or selectable via machines known in the art.

In this manner, the exercise machines and methods disclosed herein assist users in targeting muscle groups of interest not only by assisting in identifying (and in some cases automatically effectuating) changes to the exercise machine and/or use thereof, but also by confirming that the necessary changes have been made to provide the desired activation levels for the targeted muscles.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An exercise machine configured to assist a user in targeting a muscle for performing an exercise motion, the exercise machine comprising:

a sensor configured to detect a current use condition of the exercise machine while the user is performing the exercise motion, wherein the current use condition is one of multiple use conditions in which the exercise machine is operable for the user to perform the exercise motion, and wherein a current activation level of the muscle of the user to perform the exercise motion changes within the multiple use conditions for operating the exercise machine; and a control system operatively coupled to the sensor, the control system being configured to:

determine the current activation level of the muscle of the user based on the current use condition of the exercise machine detected by the sensor;

receive a desired activation level of the muscle of the user;

determine a recommended use condition within the multiple use conditions for operating the exercise machine that would cause the muscle to be at the desired activation level for performing the exercise motion; and notify the user of the recommended use condition and/or automatically cause the exercise machine to operate based on the recommended use condition, respectively, to thereby assist the user in targeting the muscle for performing the exercise motion.

2. The exercise machine according to claim 1, further comprising an incline adjustment device that controls an incline for performing the exercise motion, wherein the incline is different within the multiple use conditions for operating the exercise machine, and wherein the control system is configured to automatically control the incline adjustment device to change the incline and thereby cause the exercise machine to operate in the recommended use condition.

3. The exercise machine according to claim 2, wherein the sensor detects a position of the incline adjustment device.

4. The exercise machine according to claim 2, wherein the desired activation level ranges from a minimum activation level to a maximum activation level for the muscle for performing the exercise motion, further comprising an input device configured to receive a muscle selection input as the muscle to be targeted for performing the exercise motion, wherein the control system is configured such that when the muscle selection input is received the desired activation level for the muscle corresponding thereto is set to the maximum activation level providable by the exercise machine.

5. The exercise machine according to claim 4, further comprising a display device controllable by the control system to generate a maximum selection indication when the current activation level for the muscle is set to the maximum activation level, wherein subsequently detecting the current activation level to be below the maximum activation level causes the display device to stop generating the maximum selection indication.

6. The exercise machine according to claim 2, wherein, depending on the muscle to be targeted, the control system is configured to reduce the incline for performing the exercise motion when the desired activation level is greater than the current activation level.

7. The exercise machine according to claim 1, wherein the sensor is configured to detect a direction in which the user performs the exercise motion as at least part of the current use condition, and wherein the control system is configured to notify the user to change the direction of performing the exercise as at least part of the recommended use condition.

8. The exercise machine according to claim 1, wherein the exercise machine comprises pedals that the user moves to perform the exercise motion, and wherein the sensor detects a direction in the user moves the pedals as at least part of the current use condition.

9. The exercise machine according to claim 1, further comprising a display device controllable by the control system to indicate the current activation level of the muscle of the user based on the current use condition detected by the sensor.

10. The exercise machine according to claim 9, wherein the control system is configured to control the display device to generate a graphic of the muscle and to change a visual appearance of the graphic of the muscle based on the current activation level of muscle.

11. The exercise machine according to claim 9, wherein the muscle is a first muscle and the user has additional muscles other than the first muscle, wherein the control system is further configured to determine current activation levels corresponding to the additional muscles, respectively, based on the current use condition detected by the sensor, and wherein the control system is further configured to control the display device to indicate the current activation levels of the additional muscles.

12. The exercise machine according to claim 11, wherein the control system is configured to control the display device to generate graphics of the muscle being targeted and the additional muscles and to change colors and/or brightnesses of the graphics based on the current activations levels associated therewith, respectively.

13. The exercise machine according to claim 1, wherein the exercise machine comprises multiple regions with which the user may contact to perform the exercise, wherein the sensor is configured to detect which of the multiple regions is being contacted by the user as at least part of the current use condition, and wherein the control system is configured to notify the user to change which of the multiple regions to contact as at least part of the recommended use condition.

14. The exercise machine according to claim 1, further comprising a display device operatively coupled to the control system, wherein the control system is configured to display the current activation of the muscle over time.

15. A method for controlling an exercise machine to assist a user in targeting a muscle for performing an exercise motion, the method comprising:

detecting via a sensor a current use condition of the exercise machine while the user is performing the exercise motion, wherein the current use condition is one of multiple use conditions in which the exercise machine is operable for the user to perform the exercise motion;

determining via a control system a current activation level of the muscle of the user based on the current use condition detected by the sensor, wherein the current activation level of the muscle of the user to perform the exercise motion changes within the multiple use conditions for operating the exercise machine;

causing a display device to indicate the current activation level of the muscle;

receiving a desired activation level of the muscle;

determining a recommended use condition within the multiple use conditions for operating the exercise machine that would cause the muscle to be at the desired activation level for performing the exercise motion; and notifying the user of the recommended use condition and/or automatically causing the exercise machine to operate based on the recommended use condition, respectively, to thereby assist the user in targeting the muscle for performing the exercise motion.

16. The method according to claim 15, wherein the control system is configured to control an incline adjustment device of the exercise machine to change an incline thereof to cause the exercise machine to operate in the recommended use condition.

17. The method according to claim 15, further comprising providing an indication when the user is notified of the recommended use condition and the current activation level of the muscle does not correspond to the desired activation level after a predetermined time.

18. The method according to claim 15, wherein the desired activation level is received as a selection of the muscle for targeting from among multiple muscles of the user, and wherein upon receiving the selection of the muscle the desired activation level is set to a maximum activation level for the muscle providable by the exercise machine.

19. The method according to claim 15, wherein the sensor is configured to determine a direction in which the user is performing the exercise motion, and wherein the control system is configured to notify the user to change the direction of performing the exercise motion as at least part of the recommended use condition.

20. An exercise machine configured to assist a user in targeting a muscle for performing an exercise motion, the exercise machine comprising:

pedals moveable by the user to perform the exercise motion;

an incline adjustment device operable to change an incline of performing the exercise motion, wherein a current activation level of the muscle of the user to perform the exercise motion changes based on the incline;

one or more sensors configured to detect a current use condition of the exercise machine, the current use condition comprising the incline and a direction in which the user is moving the pedals while performing the exercise motion; and a control system operatively coupled to the sensor, the control system being configured to:

determine the current activation level of the muscle of the user based on the current use condition detected by the one or more sensors;

receive an input for a desired activation level for the muscle that exceeds the current activation level for the muscle;

determine a recommended use condition among the multiple use conditions for operating the exercise machine that would cause the muscle to be at the desired activation level for performing the exercise motion; and control the incline adjustment device to change the incline of the exercise machine and notify the user to change the direction in which the user is performing the exercise motion such that the exercise machine is operated in the recommended use condition to cause the current activation level of the muscle to correspond to the desired activation level.

* * * * *